US008960198B2

(12) United States Patent
Bailey et al.

(10) Patent No.: US 8,960,198 B2
(45) **Date of Patent: *Feb. 24, 2015**

(54) FILTER FOR A SMOKING ARTICLE

(71) Applicant: British American Tobacco (Investments) Limited, London (GB)

(72) Inventors: Mark Bailey, London (GB); Karl Kaljura, London (GB); Paul Farenden, London (GB); David Russell, London (GB); Wilbert Schoenmakers, London (GB); Darren Seymour, London (GB); David Spendlove, London (GB)

(73) Assignee: British American Tobacoo (Investments) Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/080,487

(22) Filed: Nov. 14, 2013

(65) Prior Publication Data

US 2014/0096785 A1 Apr. 10, 2014

Related U.S. Application Data

(63) Continuation of application No. 14/117,418, filed as application No. PCT/GB2012/051041 on May 11, 2012.

(30) Foreign Application Priority Data

May 13, 2011 (GB) ..... 1108034.8

(51) Int. Cl.

| | |
|---|---|
| ***A24D 3/04*** | (2006.01) |
| ***A24D 3/02*** | (2006.01) |
| ***A24D 3/06*** | (2006.01) |

(52) U.S. Cl.

CPC ..... *A24D 3/041* (2013.01); *A24D 3/0275* (2013.01); *A24D 3/061* (2013.01)

USPC ..... 131/338; 131/341

(58) Field of Classification Search

CPC ..... A24D 3/04; A24D 3/041; A24D 3/043; A24D 3/045; A24D 3/0275; A24D 3/061

USPC ..... 131/338–340, 202, 341, 344

See application file for complete search history.

(56) References Cited

U.S. PATENT DOCUMENTS 2,954,035 A * 9/1960 Saffir ..... 131/338
2,968,305 A * 1/1961 Barnett ..... 131/339

(Continued)

FOREIGN PATENT DOCUMENTS

EP 0234911 2/1987
EP 0317154 * 5/1989 ..... A24D 3/04

(Continued)

OTHER PUBLICATIONS

International Search Report and Written Opinion, mailed Aug. 9, 2012 for PCT/GB2012/051041, filed Nov. 5, 2012.

(Continued)

*Primary Examiner* — Richard Crispino
*Assistant Examiner* — Yana B Krinker
(74) *Attorney, Agent, or Firm* — N W Poulsen

(57) ABSTRACT

A filter (11) for a smoking article (10) comprises a first flowpath (13) through the filter, a second flowpath (14) through the filter, the second flowpath being disposed around the first flowpath, and a selector (16) for allowing flow selectively through the first and second flowpaths.

22 Claims, 15 Drawing Sheets

(56) References Cited

U.S. PATENT DOCUMENTS

| | | | | | |
|---|---|---|---|---|---|
| 3,016,902 | A | * | 1/1962 | Lipp et al. | 131/338 |
| 3,310,056 | A | * | 3/1967 | Rieder | 131/339 |
| 3,330,284 | A | * | 7/1967 | Seman et al. | 131/339 |
| 3,359,988 | A | * | 12/1967 | Thomson | 131/336 |
| 3,366,122 | A | * | 1/1968 | Brothers | 131/339 |
| 3,376,874 | A | * | 4/1968 | Kim et al. | 131/207 |
| 3,428,050 | A | * | 2/1969 | Kandel | 131/338 |
| 3,503,406 | A | * | 3/1970 | Riegel et al. | 131/336 |
| 4,059,043 | A | * | 11/1977 | Berger | 493/43 |
| 4,433,696 | A | * | 2/1984 | Adams | 131/336 |
| 4,527,573 | A | | 7/1985 | Hausermann | |
| 4,532,943 | A | | 8/1985 | Nichols et al. | |
| 4,593,707 | A | * | 6/1986 | Seidel et al. | 131/336 |
| 4,677,995 | A | * | 7/1987 | Kallianos et al. | 131/335 |
| 4,687,008 | A | | 8/1987 | Houck, Jr. et al. | |
| 4,848,375 | A | * | 7/1989 | Patron et al. | 131/335 |
| 8,640,713 | B2 | * | 2/2014 | Fiebelkorn | 131/198.2 |
| 2007/0012327 | A1 | * | 1/2007 | Karles et al. | 131/337 |
| 2008/0142028 | A1 | | 6/2008 | Fagg | |
| 2012/0186593 | A1 | * | 7/2012 | Grano et al. | 131/202 |
| 2014/0069447 | A1 | | 3/2014 | Bailey et al. | |
| 2014/0096785 | A1 | | 4/2014 | Bailey et al. | |
| 2014/0166031 | A1 | | 6/2014 | Bailey et al. | |

FOREIGN PATENT DOCUMENTS

| | | | | | |
|---|---|---|---|---|---|
| EP | 0317154 | A1 | | 5/1989 | |
| EP | 0671131 | | * | 9/1995 | A24D 3/04 |
| EP | 0671131 | A1 | | 9/1995 | |
| GB | 1264700 | | | 2/1972 | |
| GB | 2020537 | A | | 11/1979 | |
| WO | 84/01273 | | | 12/1984 | |
| WO | 2011051115 | A1 | | 5/2011 | |
| WO | 2011/095410 | | | 11/2011 | |

OTHER PUBLICATIONS

Written Opinion of the International Preliminary Examining Authority, mailed Aug. 7, 2013 for PCT/GB2012/051041, filed Nov. 5, 2012.

Notification of Transmittal of the International Preliminary Report on Patentability, mailed Sep. 13, 2013 for PCT/GB2012/051041, filed Nov. 5, 2012.

Office Action dated Jul. 15, 2014 for U.S. Appl. No. 14/117,418.

Office Action dated May 22, 2014 for U.S. Appl. No. 14/080,402.

Office Action dated May 23, 2014 for U.S. Appl. No. 14/080,487.

* cited by examiner

FILTER FOR A SMOKING ARTICLE

CLAIM FOR PRIORITY

This application is a Continuation of and claims priority under 35 U.S.C. §120 to U.S. application Ser. No. 14/117,418, filed Nov. 13, 2013 and entitled "Filter for a Smoking Article", which in turn is a National Stage Entry of and claims priority under 35 U.S.C. §§365 and 371 to PCT application serial no. PCT/GB2012/051041, filed May 11, 2012 and entitled "Filter for a Smoking Article," which in turn claims priority to British patent application serial no. GB1108034.8, filed May 13, 2011 and entitled "Filter for smoking article." The entire contents of the aforementioned applications are herein expressly incorporated by reference.

FIELD

The invention relates, among other things, to a filter for a smoking article.

BACKGROUND

As used herein, the term "smoking article" includes smokable products such as cigarettes, cigars and cigarillos whether based on tobacco, tobacco derivatives, expanded tobacco, reconstituted tobacco or tobacco substitutes and also heat-not-burn products. Smoking articles may be provided with a filter for removing constituents from the gaseous flow.

Filters may be provided with an additive for modifying the smoke, such as a flavourant.

Filters may have movable elements for controlling the air dilution value, the resistance-to-draw and/or the amount of added flavourant in the smoke stream. However, filters with movable elements are generally complex and so expensive to manufacture or do not provide a very satisfactory smoker experience.

SUMMARY

In accordance with embodiments of the invention, there is provided a filter for a smoking article, the filter comprising a first flow path through the filter, a second flow path through the filter, the second flow path being disposed around the first flow path, and a selector for allowing flow selectively through the first and second flow paths.

The selector may include a part that is movable in relation to the first and second flow paths to permit the selection.

The first and second flow paths may extend coaxially along the filter and the first flow path may be disposed within the second flow path.

A cylindrical first filter part and a hollow cylindrical filter part around the first filter part may respectively define the first and second flow paths.

An extended part of the first filter part may be received in a recess in the selector, wherein the recess preferably narrows towards the end wall of the recess. The selector may include a protrusion on the end wall of the recess that extends into and engages with the first filter part and/or at least one further protrusions on a side wall of the recess, wherein the further protrusion is adapted to allow movement of the first filter part towards the end wall of the recess during assembly and thereafter prevent movement in the opposite direction. The protrusion may be adapted to distort the first filter part so that it engages with the side wall of the recess. A layer may be arranged between the first and second filter parts and may extend with the first filter part into the recess.

Alternatively, an extended part of the second filter part may form a recess that receives a tubular part of the selector, wherein the tubular part preferably widens towards its end at the opening of the recess.

The selector may comprises a first selector part, substantially fixed in relation to the first and second filter parts; and a second selector part, rotatable and/or axially displaceable in relation to the first selector part.

The first selector part may have a first set of one or more windows aligned with the first filter part and a second set of one or more windows aligned with the second filter part; and the second selector part may be rotatable in relation to the first selector part and may have a third set of one or more windows alignable with the first set of windows for selecting the first flow path, or with the second set of windows for selecting the second flow path, or with a proportion of the first and second sets of windows for selecting the proportion of the first and second flow paths.

Alternatively, the first selector part may have a first flow path in communication with the first flow path defined by the first filter part and a second flow path in communication with the second flow path defined by the second filter part; and the second selector part may be axially displaceable in relation to the first selector part and may have a part adapted to open or close a section of the first flow path in the first selector part in dependence upon the axial displacement. The part and/or the section may have a conical shape. Alternatively, the part may have a constant outer diameter; the section may comprise two or more constant-diameter sections separated by one or more steps; and the part may be moveable into a selected one of the constant-diameter sections thereby permitting the selection of one of two or more discrete levels of flow through the first flow path. The filter may include a threaded connection between the first and second selector parts for allowing the axial displacement to be changed by way of a rotating force.

At least one of the flow paths may include additive. The filter may include an additive release component adapted to release the additive in response to being deformed and/or broken. The additive release component may be deformable and/or breakable by movement of the part of the selector. The additive release component may be included in the selector. The part of the second selector part may be further adapted to urge the additive release component against a part of the first selector part so as to release the additive. The part of the first selector part may include one or more protrusions adapted to cause the additive to be released preferentially into the first filter part.

In accordance with embodiments of the invention, there is provided a filter for a smoking article, the filter comprising a first flow path through the filter, a second flow path through the filter, the second flow path being disposed around the first flow path, and a part that is movable in relation to the first and second flow paths to allow flow selectively through the first and second flow paths.

In accordance with embodiments of the invention, there is provided a method of providing a sealed attachment between a first part comprising wrapped filter material and a second part made of a rigid material, the method comprising providing a recess in the second part, the recess having a protrusion on its end wall and/or a shape that narrows towards its end wall; and inserting the first part into the recess, thereby causing the protrusion and/or the shape to distort the part so that it engages with a side wall of the recess.

BRIEF DESCRIPTION OF THE DRAWINGS

Embodiments of the present invention will now be described, by way of example only, with reference to the accompanying drawings, in which.

DESCRIPTION OF EMBODIMENTS

First Embodiment

Figure 1:
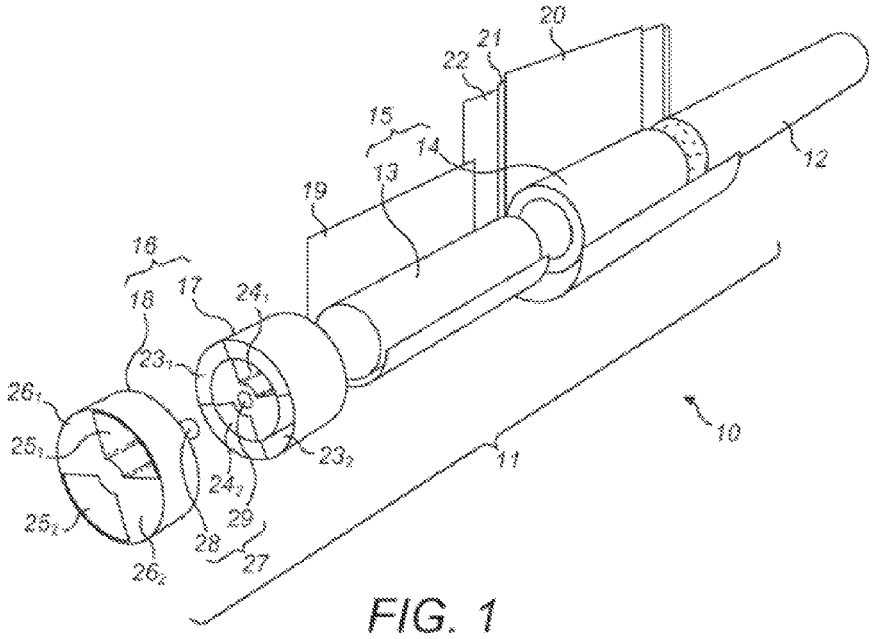
FIG. 1 is an exploded perspective view of a smoking article including a filter according to a first embodiment of the invention.
Figure 2:
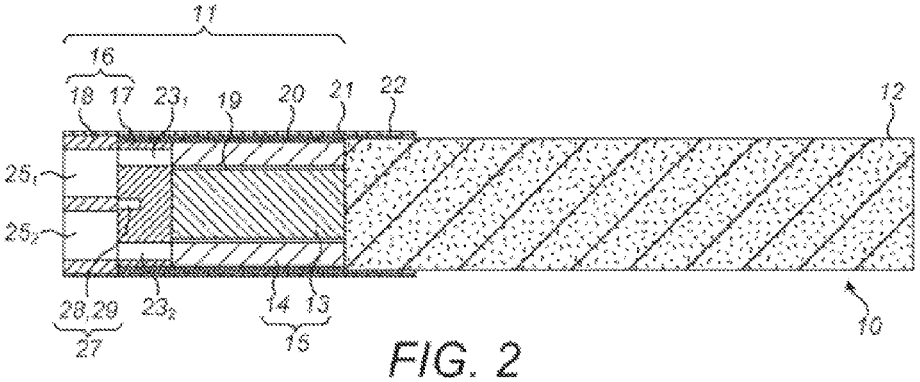
FIG. 2 is a sectional view of the smoking article of FIG. 1.

FIGS. 1 and 2 show a smoking article 10 including a filter 11 according to a first embodiment of the invention. The smoking article 10 includes a source of smokable material, which is preferably tobacco, in the form of a cylindrical tobacco rod 12. The filter 11 is co-axially attached to the tobacco rod 12.

The filter 11 includes inner and outer filter parts 13, 14 which define respective inner and outer flow paths through a main filter part 15. The inner filter part 13 includes an additive, e.g. flavourant (not shown). A selector 16 at the end of the main filter part 15 includes first and second selector parts 17, 18 which are rotatable in relation to each other for selecting one of the flow paths or an adjustable proportion of both of the flow paths. A barrier layer 19, inner and outer wrapping layers 20, 21 and a covering layer 22 are also included.

The outer filter part 14 forms a hollow cylindrical tube having an outer diameter which is substantially the same as the outer diameter of the tobacco rod 12. The inner filter part 13 forms a cylinder having a diameter and length which are substantially the same as the inner diameter and length respectively of the outer filter part 14. The inner filter part 13 is co-axially and co-extensively arranged inside the outer filter part 14, thus forming the cylindrical main filter part 15. The inner and outer filter parts 13, 14 preferably have respective outer and inner diameters such that they have substantially the same cross-sectional areas. For example, the outer filter part 14 may have a diameter of around 7.8 mm and the inner filter part 13 may have a diameter of around 5.4 mm. However, different cross-sectional areas may be used to provide a filter 11 having different characteristics.

The inner and outer filter parts 13, 14 each include filtration material. The filtration material in each filter part preferably includes a homogenous filtration material, e.g. conventional cellulose acetate tow. The term "homogenous" is used to mean that the filtration material is substantially uniform throughout each filter part 13, 14, and in particular, is uniform in a radical direction through each filter part 13, 14. The inner and outer filter part 13, 14 may include different filtration materials or filtration materials having different physical properties, e.g. density and/or firmness.

The inner filter part 13 includes the additive, which is preferably a flavourant but may also be a different type of additive. For example, the additive may be selected from the one or more types: flavourants (e.g. menthol, peppermint), cooling agents providing a cooling sensation (e.g. menthol), or smoke modifying agents (e.g. water, charcoal). The additive is preferably included in an additive release component (not shown) from which it can be released by a smoker. The additive release component preferably contains an additive in the form a liquid, preferably a liquid. The additive in the additive release component may be a flavourant, e.g. menthol, or may be water. The additive release component preferably includes a capsule comprising an outer wall, which is preferably made of gelatine, an inner space filled with the fluid additive. The additive release component may be ruptured or broken by compression, which releases the additive. The additive release component provides for selective release of the additive into the filter part in which it is located. Prior to release of the additive, the filter part contains the additive in an inactive state, in which the additive does not affect the smoke. The term "release" is intended to include exposure of the additive to the atmosphere, in addition to physical release and movement out of an encapsulation. The term "release" indicates that the additive is active, and can have an effect on the smoking article 10. Whilst encapsulated, the additive is dormant and does not have an effect.

The flavourant is preferably encapsulated to prevent it from migrating to other parts of the filter 11 or smoking article 10 during storage. If the flavourant is menthol, which is relatively highly volatile, then the encapsulation can be especially important. However, in some instances, the flavourant may be in the form of a powder dispersed throughout the filtration material or it may be applied to a substrate, e.g., a thread, which is embedded in the filtration material.

The barrier layer 19 is arranged between the inner and outer filter parts 13, 14. The barrier layer 19 is preferably formed of a material, e.g. a paper, which is substantially impermeable to liquids and gaseous flow. The paper may be coated to be impermeable to liquids. The barrier layer 19 covers substantially all the outer surface of the inner filter part 13. The barrier layer 19 is preferably affixed to the inner filter part 13 and/or is secured around it by a longitudinal seam of adhesive joining opposite edges. Thus, the barrier layer 19 prevents flavoured or unflavoured smoke from passing from the inner to the outer filter part 13, 14 or vice versa when the smoking article 10 is in use, and also prevents the flavourant from passing from the inner to the outer filter part 13, 14 after it has been released, for example. If the flavourant is menthol, which is relatively highly volatile, then provision of the barrier layer 19 can be especially important.

The first selector part 17 forms a cylinder having a plurality of openings, or windows $\mathbf{23}_1$, $\mathbf{23}_2$, $\mathbf{24}_1$, $\mathbf{24}_2$, extending axially throughout the whole length of the cylinder. The windows consist of two outer windows $\mathbf{23}_1$, $\mathbf{23}_2$ and two inner windows $\mathbf{24}_1$, $\mathbf{24}_2$. The first selector part 17 has a diameter which is substantially the same as the diameter of the main filter part 15. The first selector part 17 is co-axial with and adjoins the main filter part 15 at the end of the main filter part 15 which is distant from the tobacco rod 12. The first selector part 17 is preferably made of a plastics material.

Each outer window $\mathbf{23}_1$, $\mathbf{23}_2$ in the first selector part 17 has a cross-section in the form of an annular sector, i.e. a portion of an annulus between two arcs and two radial lines joining the arcs. The annulus around the outer windows $\mathbf{23}_1$, $\mathbf{23}_2$ is centred on the axis of rotation of the second selector part 18. This annulus has an outer diameter such that the first selector part 17 has a relatively thin cylindrical wall around the windows and an inner diameter which is substantially the same as the inner diameter of the outer filter part 14. The outer windows $\mathbf{23}_1$, $\mathbf{23}_2$ each have an angular extent of around 90° and are rotationally offset from each other by around 180°, i.e. they are diametrically opposed.

Each inner window $\mathbf{24}_1$, $\mathbf{24}_2$ in the first selector part 17 has a cross-section in the form of an annular sector. The annulus around the inner windows $\mathbf{24}_1$, $\mathbf{24}_2$ is also centred on the axis of rotation of the second selector part 18. This annulus has an outer diameter which is substantially the same as the outer diameter of the inner filter part 13 and an inner diameter such that the first selector part 17 has a relatively small central cylindrical section. The inner windows $\mathbf{24}_1$, $\mathbf{24}_2$ each have an angular extent of around 90°, are rotationally offset from each other by around 180° and are rotationally offset from the outer windows $\mathbf{23}_1$, $\mathbf{23}_2$ by around 90°.

The second selector part 18 forms a cylinder having two windows $\mathbf{25}_1$, $\mathbf{25}_2$ extending axially throughout the whole length of the cylinder. The second selector part 18 has a diameter which is substantially the same as the diameter of the first selector part 17. The second selector part 18 is co-axial with and adjoins the first selector part 17 at the end of the first selector part 17 which is distant from the main filter part 15. The second selector part 18 is preferably made of a plastics material. Each of the windows $\mathbf{25}_1$, $\mathbf{25}_2$ in the second selector part 18 has a cross-section in the form of an annular sector. The annulus around the windows $\mathbf{25}_1$, $\mathbf{25}_2$ centred on the axis of rotation of the second selector part 18. This annulus has substantially the same outer diameter as that of the outer windows $\mathbf{23}_1$, $\mathbf{23}_2$ in the first selector part 17 and substantially the same inner diameter as that of the inner windows $\mathbf{24}_1$, $\mathbf{25}_2$ in the first selector part 17. The windows $\mathbf{25}_1$, $\mathbf{25}_2$ each have an angular extent of around 90° and are rotationally offset from each other by around 180°. The portions of the second selector part 18 between the windows $\mathbf{25}_1$, $\mathbf{25}_2$ form shutters $\mathbf{26}_1$, $\mathbf{26}_2$.

The first and second selector parts 17, 18 include means 27 for connecting them together. Preferably, the end surface of the second selector part 18 which faces the first selector part 17 includes a central, axially extending pin 28. The oppositely facing end surface of the first selector part 17 has a central socket 29. The pin 28 and socket 29 are shaped such that, once they have been engaged with each other, they form a connection which substantially prevents relative axial or radial displacement of the first and second selector parts 17, 18 while allowing relative rotation. For example, the pin 28 may have an enlarged end section at its distal end and the socket 29 may be shaped complementarily so that the pin 28 is a snap fit in the socket 29.

The inner wrapping 20 encircles the main filter part 15 and also the first selector part 17. The inner wrapping layer 20, e.g. plug wrap, is preferably a porous paper but may also be a non-porous paper. The inner wrapping layer 20 is affixed to the main filter part 15 and the first selector part 17 and/or is secured around them by a longitudinal seam of adhesive joining opposite edges. Thus, the wrapping layer helps to hold the main filter part 15 and the first selector part 17 together, e.g. during manufacture. In some cases, the inner wrapping layer 20 may be omitted.

The outer wrapping layer 21 encircles the inner wrapping layer 20 and an adjacent length of the tobacco rod 12. The outer wrapping layer 21, e.g. plug wrap, is preferably a porous paper but also be a non-porous paper. The outer wrapping layer 21 is affixed to the inner wrapping layer 20 and the length of tobacco rod 12 and/or is secured around them by a longitudinal seam of adhesive joining opposite edges. Thus, the outer wrapping layer 21 joins the main filter part 15 to the tobacco rod 12 and forms a seal against air ingress between the main filter part 15 and the tobacco rod 12 during use, i.e., when the smoker draws on the smoking article 10.

The covering layer 22 encircles the second selector part 18 and also the outer wrapping layer 21. The covering layer 22 is preferably formed of a paper material, e.g. tipping paper. The covering layer 22 is affixed to at least a portion of the outer surface of the second selector part 18. The covering layer 22 is also secured by a longitudinal seam of adhesive joining opposite edges, thus forming a cylindrical sleeve. There is a sliding fit between the covering layer 22 and the outer wrapping layer 21 which forms a seal against air ingress between the covering layer 22 and the outer wrapping layer 21 during use. Also, the filter 11 is adapted such that the friction between the covering layer 22 and the outer wrapping layer 21 and between the first and second selector parts 17, 18 allows the covering layer 22 and the affixed second selector part 18 to be easily rotated by the smoker but otherwise holds them in position.

Use of the First Embodiment

In use, the smoker can manipulate the filter 11 to control the flavouring of the smoke.

In an initial, un-activated state, the flavourant is encapsulated and so smoke drawn from the filter 11 will be unflavoured regardless of the relative rotation of first and second selector parts The smoker can activate the filter 11 by applying inward radial pressure to, and thus deforming, the main filter 15 and the additive release component or capsule included therein. This causes the capsule to rupture and release the flavourant.

Figure 3A:
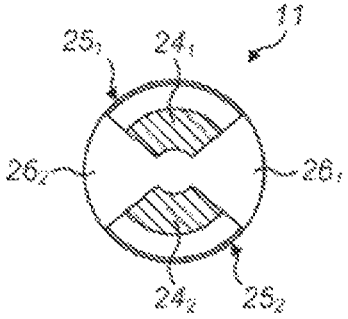
FIG. 3 is an end view of the smoking article of FIG. 1 in a first state (a), in a second state (b) and in a third state (c)

FIG. 3*a* shows the filter 11 in one of the two positions corresponding to the first activated state. The other of the two positions is obtained by rotating the second selector part 18 by 180° in relation to the first selector part 17. In this state, the shutters $\mathbf{26}_1$, $\mathbf{26}_2$ of the second selector part 18 are aligned with the outer windows $\mathbf{23}_1$, $\mathbf{23}_2$ in the first selector part 17 while the windows $\mathbf{25}_1$, $\mathbf{25}_2$ in the second selector part 18 are aligned with the inner windows $\mathbf{24}_1$, $\mathbf{24}_2$ in the first selector part 17. In other words, the outer windows $\mathbf{23}_1$, $\mathbf{23}_2$ are shut and the inner windows $\mathbf{24}_1$, $\mathbf{24}_2$ are open. Thus, when the smoker draws on the smoking article 10, smoke will be channelled through the inner filter part 13, which contains released flavourant, and will not be channelled through the outer filter part 14. Hence the smoke which is drawn from the selector 16 will have the strongest flavour, the strength of the flavour depending upon the characteristics of the inner filter part 13.

During manufacture, the filter 11 is preferably arranged in a position such that, after the smoker has activated the filter 11, it is in the first activated state and the smoke which is drawn from the selector 16 has the strongest flavour.

The smoker can hold and rotate the covering layer 22 in relation to the tobacco rod 12 so as to cause the second selector part 18 to rotate in relation to the first selector part 17. This changes the filter 11 between the first, activated state and second and third states corresponding to strongest flavoured, adjustably flavoured and unflavoured smoke respectively. Hence, after releasing the flavourant, the smoker can still adjust the strength of flavour of the smoke and can even revert to unflavoured smoke.

Figure 3B:
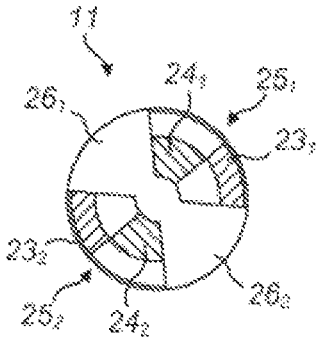

FIG. 3*b* shows the filter 11 in a position corresponding to the second activated state. In this state, the shutters $\mathbf{26}_1$, $\mathbf{26}_2$ in the second selector part 18 are partly aligned with the inner windows $\mathbf{24}_1$, $\mathbf{24}_2$ in the first selector part 17 while the windows $\mathbf{25}_1$, $\mathbf{25}_2$ in the second selector part 18 are partly aligned with the outer windows $\mathbf{23}_1$, $\mathbf{23}_2$ in the first selector part 17. In other words, both the outer and inner windows $\mathbf{23}_1$, $\mathbf{23}_2$, $\mathbf{24}_1$, $\mathbf{24}_2$ are partly open. Thus, when the smoker draws on the smoking article 10, smoke is channelled through both the inner and outer filter parts 13, 14. Hence the smoke which is drawn from the selector 16 will include flavoured smoke and unflavoured smoke. The strength of the flavour of the smoke will depend upon the proportion of flavoured and unflavoured smoke. This depends upon the relative extent to which the outer and inner windows $\mathbf{23}_1$, $\mathbf{23}_2$, $\mathbf{24}_1$, $\mathbf{24}_2$ are open and hence upon the relative angle of rotation of the first and second selector parts 17, 18.

Figure 3C:
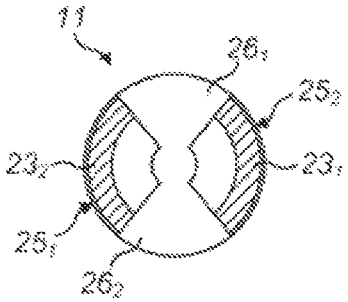

FIG. 3*c* shows the filter 11 in one of the two positions corresponding to the third activated state. The other of the two positions is obtained by rotating the second selector part 18 by 180° in relation to the first selector part 17. In the first activated state, the shutters $\mathbf{26}_1$, $\mathbf{26}_2$ of the second selector part 18 are aligned with the inner windows $\mathbf{24}_1$, $\mathbf{24}_2$ in the first selector part 17 while the windows $\mathbf{25}_1$, $\mathbf{25}_2$ in the second selector part 18 are aligned with the outer windows $\mathbf{23}_1$, $\mathbf{23}_2$ in the first selector part 17. In other words, the inner windows $\mathbf{24}_1$, $\mathbf{24}_2$ are shut and the outer windows $\mathbf{23}_1$, $\mathbf{23}_2$ are open. Thus, when the smoker draws on the smoking article 10, smoke will be channelled through the outer filter part 14, which is unflavoured, and will be not be channelled though the inner part 13. Hence the smoke which is drawn from the selector 16 will be unflavoured.

As the smoker rotates the covering layer 22 in relation to the tobacco rod 12 away from a position corresponding to the first, strongest flavoured state, the strength of the flavour of the smoke decreases gradually until the smoke is unflavoured after a 90° clockwise or anticlockwise rotation, i.e., at a position corresponding to the third state.

Conversely, as the smoker rotates the covering layer 22 in relation to the tobacco rod 12 away from a position corresponding to the third, unflavoured state, the strength of the flavour of the smoke increases gradually until it is strongest after a 90° clockwise or anticlockwise rotation, i.e., at a position corresponding to the first state.

The covering layer 22 and a length of tobacco rod 12 adjacent to the end of the covering layer 22 are preferably provided with markings (not shown) which indicate the various different states of the filter 11. The markings may include a scale indicating the strength of flavour of the smoke.

It will be appreciated that, if additive other than flavourant is used, then the different states of the filter 11 will correspond to different amounts of modification of the smoke rather than different strengths of flavour of the smoke.

Variations of the First Embodiment

Some variations and modifications of the filter 11 will now be described. It will be appreciated that any of the features described in any embodiment may be used in combination with any other features of any other combinations.

Figure 4:
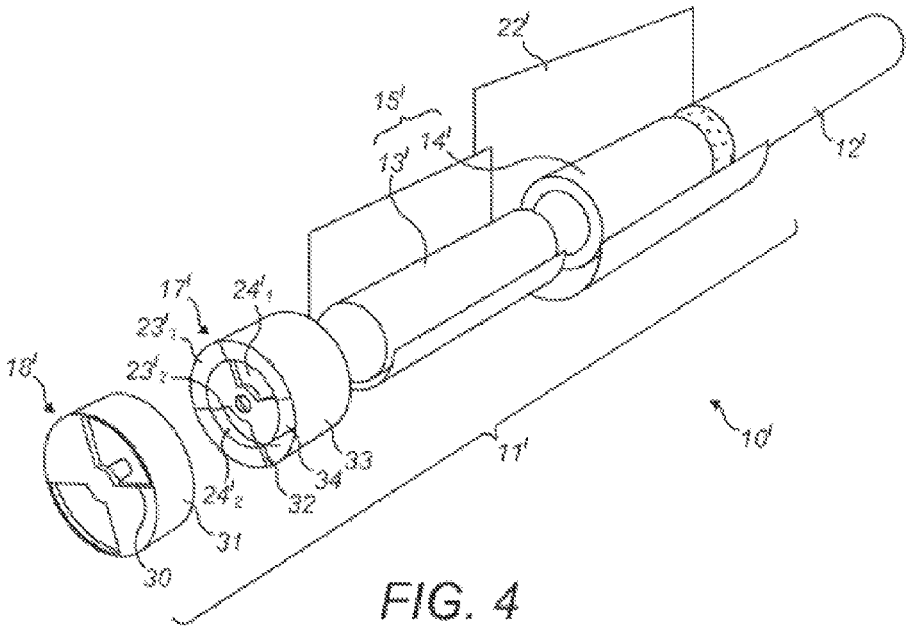
FIG. 4 is an exploded perspective view of a smoking article including a filter according to a further embodiment of the invention.

FIG. 4 shows a smoking article 10' including a filter 11' according to a further embodiment of the invention. The filter 11' is similar to the filter 11 (FIG. 1). However, in this embodiment, a modified second selector part 18' includes a main part 30 and a sleeve part 31. The main part 30 has the same cross-section as the second selector part 18 (FIG. 1) of the first embodiment but has a shorter length, i.e., is relatively thin. The sleeve part 31 is a thin-walled cylindrical tube which has substantially the same outer diameter as the main part 30. The sleeve part 31 extends co-axially from the end surface of the main part 30 which faces towards the first selector part 17'. The sleeve part 31 encircles and forms a sliding fit around a length of the first selector part 17'. This increases the mechanical strength of the selector 16' and also forms a seal against air ingress between the first and second selector parts 17', 18' during use.

In the embodiment shown in FIG. 4, a modified first selector part 17' includes a main part 32 and two sleeve parts 33, 34. The main part 32 has the same cross-section as the second selector part 17 (FIG. 1) of the first embodiment but has a shorter length, i.e., is relatively thin. The sleeve parts 33, 34 are thin-walled cylindrical tubes which extend co-axially from the end surface of the main part 32 which faces towards the main filter part 15'. The first sleeve part 33 has substantially the same outer diameter as the main part 30 and the second sleeve part 34 is arranged such that it forms two concentric chambers in the first selector part 17', one of which connects the inner filter part 13' to the inner windows $\mathbf{24'}_1$, $\mathbf{24'}_2$ and the other of which connects the outer filter part 14' to the outer windows $\mathbf{23'}_1$, $\mathbf{23'}_2$. The first and second sleeve parts 33, 34 are preferably tapered so that they each have a thin, circular edge at their ends nearest to the main filter part 15'. Thus, the first and second sleeve parts 33, 34 may encircle lengths of the outer and inner filter parts 14', 13' respectively. This arrangement can help to improve the seal between the first selector part 17' and the main filter part 15'. In particular, the first sleeve part 33 can help to prevent air ingress into the first selector part 17' and the second sleeve part 34 can help to prevent smoke from the inner filter part 13' from reaching the outer windows $\mathbf{24'}_1$, $\mathbf{24'}_2$ or smoke from the outer filter part 14' from reaching the inner windows $\mathbf{23'}_1$, $\mathbf{23'}_2$. The modified first and second selector parts 17', 18' can also provide a lighter weight and/or more compact selector.

In the embodiment shown in FIG. 4, a modified covering layer 22' does not encircle the second selector part 18' but is used to join the main filter part 15' to the tobacco rod 12'. Thus, the outer wrapping layer 21 (FIG. 1) may be omitted. In this case, the covering layer 22' encircles the a length of the second first connector part 17', the main filter part 15', and a length of the tobacco rod 12' and is affixed to and/or secured around them. Thus, rather than holding and rotating the covering layer 22 (FIG. 1) in relation to the tobacco rod 12 (FIG. 1) as in the first embodiment, for example, the smoker can hold and rotate the second selector part 18' itself.

With the modified covering layer 22', the seal between the first and second selector parts 17', 18' should be such that air ingress between them is substantially prevented during use. Thus, the modified covering layer 22' is preferably combined with the modified second selector part 18'. However, the modified covering layer 22' may also be used with the second selector part 18 (FIG. 1) of the first embodiment. The modified second selector part 18' may also be used with the covering layer 22 (FIG. 1) of the first embodiment.

Figure 5:
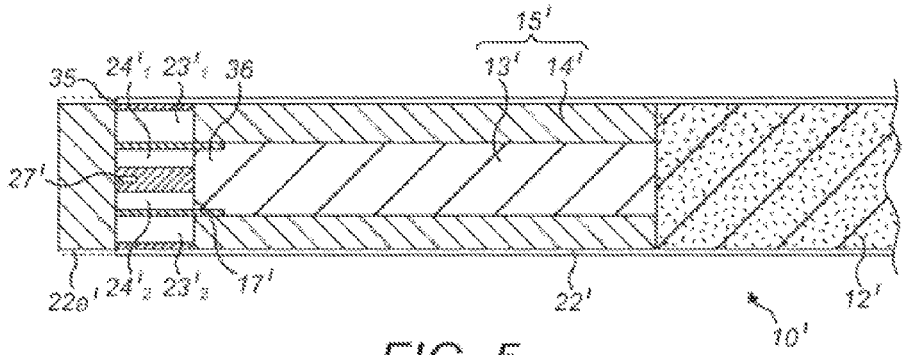
FIG. 5 is a sectional view of a smoking article including a filter according to a further embodiment of the invention.

FIG. 5 shows a smoking article 10" including a filter 11" according to a further embodiment of the invention. The filter 11" is similar to the filter 11 except that a modified covering layer 22" has an extended portion 22"*a* which encircles and is affixed to and/or secured around the second selector part 18". The extended portion 22"*a* is separated from the other portion 22" of the covering layer by a line of perforations 35, preferably around where the first and second selector parts 17", 18" meet. Thus, the covering layer 22", 22"*a* weakly joins the first and second selector parts 17", 18" to each other. This can help to maintain their initial relative orientation, e.g. in a position corresponding to the first, strongest flavoured state. When the smoker first causes the second selector part 18" to rotate in relation to the first selector part 17", the covering layer 22", 22"*a* tears along the line of perforations 35 thereby providing tactile and/or audible feedback to the smoker.

Alternatively, for example in the first embodiment (see FIG. 1), the inner and/or outer wrapping layer 20, 21, rather than the covering layer 22, may have an extended portion for weakly joining the first and second selector parts 17, 18 to each other.

In the embodiment shown in FIG. 5, the first selector part 17" includes a spigot 36, i.e. a hollow cylindrical tube, which extends axially from the centre of the end surface of the first selector part 17" which faces the main filter part 15". The spigot 36 engages in a recess provided in the centre of the oppositely facing end surface of the inner filter part 13". The spigot 36 preferably has an outer diameter which is substantially the same as the outer diameter of the inner filter part 13" and an inner diameter which is substantially the same as the outer diameter of the inner windows $\mathbf{23"}_1$, $\mathbf{23"}_2$ in the first selector part 17". The spigot 36 helps to prevent smoke from the inner filter part 13" from entering the outer windows $\mathbf{24"}_1$, $\mathbf{24"}_1$ or smoke from the outer filter part 14" from entering the inner windows $\mathbf{23"}_1$, $\mathbf{23"}_2$.

The embodiment shown in FIG. 5 can be readily manufactured using a method in which two 'back-to-back' conjoined filters 11" are wrapped simultaneously with two tobacco rods 12" and then cut laterally to form two smoking articles 10".

Figure 6:
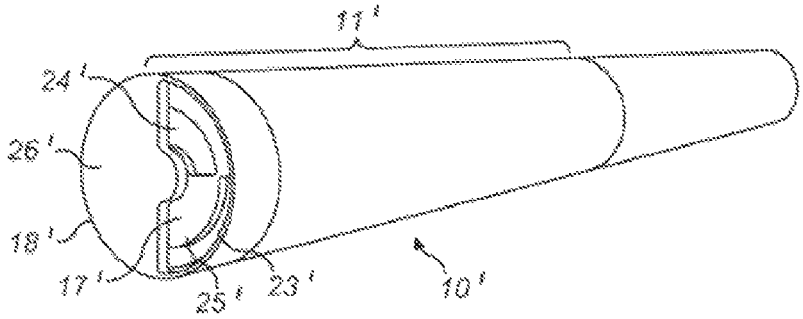
FIG. 6 is a perspective view of a smoking article including a filter according to a further embodiment of the invention.

FIG. 6 shows a smoking article 10'" including a filter 11'" according to a further embodiment of the invention. The filter 11'" is similar to the filter 11' (FIG. 4). In this embodiment, the first selector part 17'" has only one outer window 23'" and only one inner window 24'". The outer window 23'" and the inner window 24'" correspond respectively to one of the outer windows 23' (FIG. 4) and one of the inner windows 24' (FIG. 4) described above, except that they each have an angular extent of around 180° and are rotationally offset from each other by around 180°. Also, the second selector part 18'" has only one window 25'" which corresponds to one of the windows 25' (FIG. 4) described above except that it has an angular extent of around 180°.

Figure 7A:
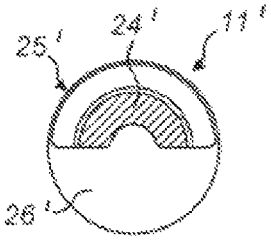
FIG. 7 is an end view of the smoking article of FIG. 6 in a first state (a), in a second state (b) and in a third state (c)
Figure 7B:
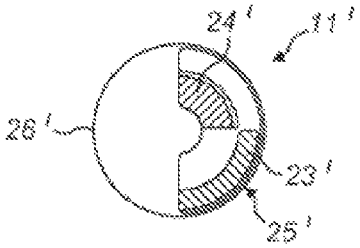
Figure 7C:
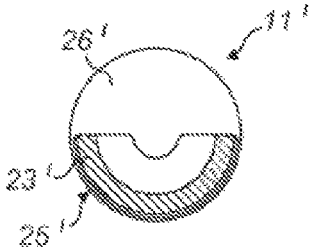

FIG. 7 shows the filter 11'" in positions corresponding to the first, second and third activated states. A 180° clockwise or anticlockwise rotation changes the filter 11'" from the first state via the second state to the third state and vice versa. This can allow the smoker to control the strength of flavour more precisely.

There may be different number of windows in the first and second selector parts or the windows may have different sizes or shapes or may be arranged differently from the embodiments described above. For example, referring to FIG. 1, the windows 25 in the second selector part 18 may extend over a smaller angle than the windows 23, 24 in the first selector part 17. Thus, there may be a range of angles over which the filter 11 is in the first, strongest flavoured state or in the third, unflavoured state. This can make it easier for the smoker to select these states.

The filter may include means for indexing the relative rotation between the first and second selector parts, limiting the rotation, and/or providing tactile and/or audible feedback to the smoker during the rotation.

For example, referring to FIG. 1, the facing end surfaces of the first and second selector parts 17, 18 may be respectively provided with first and second indexing sections. The first indexing section preferably has a plurality of elongate grooves, separated by ridges, which extend substantially radially. The ridge between adjacent depressions may have a curved profile or may have a pointed, creased, or tapering profile. The second indexing section has one or more features engagable with the first indexing section. The second indexing section may have substantially the same profile and formation as the first indexing section, in which case both the first and second indexing sections may provide protrusions which engage in depressions in the other of the first and second indexing sections. The means 27 for connecting the first and second selector parts 17, 18 together is resiliently deformable to allow the protruding features of each portion to releasably engage.

Thus, relative rotation of the first and second selector parts 17, 18 is resisted unless sufficient force is applied to rotate to the next indexed position. This helps to prevent accidental rotation away from an initial or smoker-selected position. The indexing means preferably defines a plurality of positions corresponding to different states of the filter. For example, there may be five positions, one position corresponding to the first strongest flavoured state ("100%"), three different positions corresponding to the second, partially flavoured state ("75%", "50%" and "25%") and one position corresponding to the third, unflavoured state ("0% flavouring"). The indexing means may also be adapted to limit rotation to a predetermined range of angles, e.g. to a 90° range between a position corresponding to the first strongest flavoured state and a position corresponding to the third, unflavoured state. The indexing means also provides smoker feedback during the rotation in the form of touch and/or sound, e.g. a click, as each indexing position is engaged.

Alternatively, the first and second indexing means may be respectively provided on the inner and outer surfaces of the outer wrapping layer 21 and the covering layer 22 respectively or of the modified first and second connector parts 17', 18' (FIG. 4) respectively.

Instead of the selector 16 (FIG. 1), another type of selector may be used, e.g. a mechanical iris, for selecting between inner and outer flow paths.

Instead of being rotatable, the parts of the selector may be slideable or otherwise moveable in relation to the each other.

For example, referring to FIG. 1, the socket 29 in the first selector part 17 may extend in a radial direction so that the pin 28 on the second selector part 18 can slide along it. Also, the pin 28 may have a square or rectangular cross-section so that it cannot rotate in the socket 29. In this case, the windows 23, 24, 25 in the first and second selector parts 17, 18 are adapted such that smoke can be channelled through only the inner filter part 13, through only the outer filter part 14 or through an adjustable proportion of the inner and outer filter parts 13, 14.

Alternatively, the selector parts 17, 18 may be slideable in relation to each other in an axial rather than a radial direction. For example, the selector parts 17, 18 may each include hollow cylindrical parts, one of which fits slideably inside the other, and which have one or more windows in their circumferential walls which can be opened to closed by sliding the selector parts 17, 18 in relation to each other in an axial direction.

The selector parts 17, 18 may also be moveable helically in relation to each other, e.g. by virtue of them being provided with complementary threads.

The additive release components, e.g. encapsulated flavourant, may be arranged such that the filter 11 can be activated by moving the second selector piece 18 in some way, e.g. away from its initial position. For example, the second selector piece 18 may be affixed to the covering layer 22 and the covering layer 22 may include one or more protrusions on its interior surface. These protrusions may be arranged such that, when the covering layer 22 is rotated in relation to main filter part 15, the protrusions are forced against the filter part which includes the capsules or against the capsules themselves, thereby deforming the capsules and causing them to break and release the flavourant.

Second Embodiment

Figure 8A:
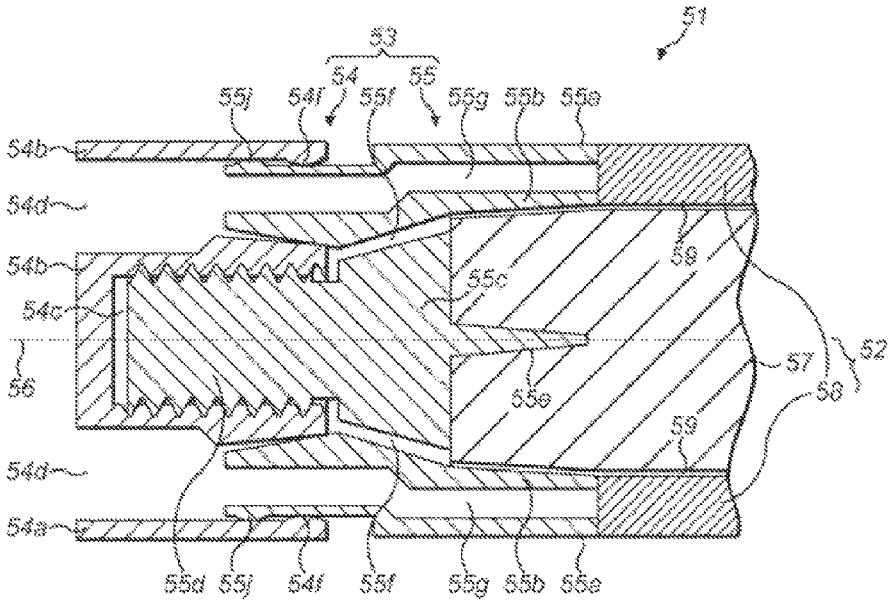
FIG. 8*a* is a cross-sectional view of a part of a filter according to a second embodiment of the invention.
Figure 8B:
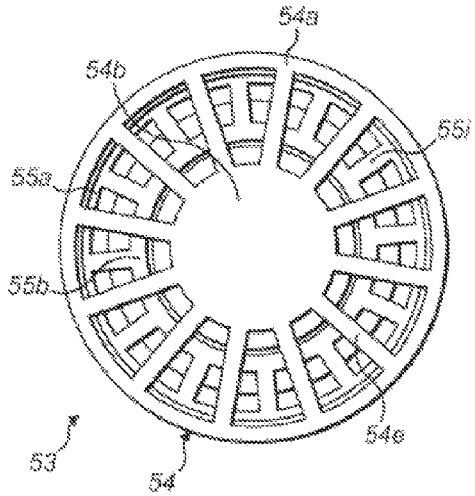
FIG. 8*b* is a first ("near") end view of the selector shown in FIG. 8*a;*
Figure 8C:
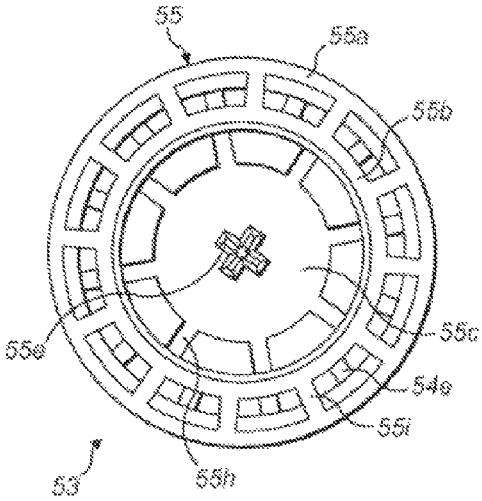
FIG. 8*c* is a second ("far") end view of the selector shown in FIG. 8*a;*

FIGS. 8*a*, 8*b* and 8*c* show different views of a part of a filter 51 according to a second embodiment of the invention. The filter 51 includes a main filter part 52, one end of which is to be attached to an end of a tobacco rod (not shown) similar to the tobacco rod 12 of the first embodiment, and another end of which is attached to a selector 53. The selector 53 includes first and second selector pieces 54, 55. As will be described in more detail below, the second selector piece 55 is attached to the main filter part 52, and the first selector piece 54 is moveably attached to the second selector piece 55. The tobacco rod, main filter part 52, and first and second selector pieces 54, 55 are generally-cylindrical, have a similar outer-diameter, and are arranged co-axially, thereby defining a axis 56.

The relative axial positions of some of the parts of the filter 51 will be described below as if the filter 51 is orientated such that the tobacco rod is at the far end of the filter 51. The words "near" and "far" are to be understood accordingly. This is merely for convenience. It will be appreciated that the filter 51 can be oriented in any way.

The main filter part 52 includes inner and outer filter parts 57, 58 which define respective inner and outer flow paths. The inner and outer filter parts 57, 58 are the same as the inner and outer filter part 13, 14 of the first embodiment, except that, as will be explained in more detail below, they have different lengths. As in the first embodiment, the inner filter part 57 includes an additive, such as flavourant, preferably included in an additive release component (not shown).

An intermediate layer 59 is arranged between the inner and outer filter parts 57, 48. The intermediate layer 59 is the same as the barrier layer 19 of the first embodiment.

The inner filter part 57 can have an additional plugwrap wrapping (not shown). The outer filter part 58 can also have a plugwrap wrapping (not shown).

The first and second selector pieces 54, 55 can be made of a plastics material or other suitable materials.

As will become apparent, the first and second selector pieces 54, 55 are moveable in relation to each other in order to adjustably open and close the inner flow path in the second selector piece 54, while the outer flow path is open throughout this movement.

The first selector piece 54 comprises an outer, generally-cylindrical tube part 54*a* and an inner, generally-cylindrical part 54*b*. The axes of the parts 54*a*, 54*b* are both coincident with the axis 56. The parts 54*a*, 54*b* are largely coextensive. The part 54*b* is solid except that it includes a recess 54*c* which will be described in more detail below. An annular space 54*d* between the parts 54*a*, 54*b* defines a flow path through the first selector piece 54. The parts 54*a*, 54*b* are connected to each other by a plurality of radially-extending structures ("spokes") 54*e*. Each of the spokes 54*e* has an elongated rectangular cross-section which is aligned with the axis 56. The spokes 54*e* extend from the near end of the first selector piece 54 for part of its length.

The second selector piece 55 includes an outer, generally-cylindrical tube part 55*a*, an intermediate, generally-cylindrical tube part 55*b* and an inner generally-cylindrical solid part 55*c*. The axes or the parts 55*a*, 55*b*, 55*c* are all coincident with the axis 56. The outer and intermediate parts 55*a*, 55*b* are substantially coextensive, while the inner part 55*c* (not including the protrusion 55*d* and the spike 55*e* described in more detail below) is shorter and is arranged centrally in relation to the other parts 55*a*, 55*b*. The intermediate part 55*b* divides the second selector piece 55 into inner and outer spaces 55*f*, 55*g* defining respective inner and outer flow paths. The intermediate and inner parts 55*b*, 55*c* are connected to each other by a plurality of inner spokes 55*h*. The outer and intermediate parts 55*a*, 55*b* are connected to each other by a plurality of outer spokes 55*i*. The spokes 55*h*, 55*i* are similar to the spokes 54*e* in the first selector piece 54.

The first and second selector pieces 54, 55 are attached to each other by way of a screw-threaded connection. The inner part 55*c* of the second selector piece 55 includes a threaded cylindrical protrusion 55*d* which co-operates with a threaded cylindrical recess 54*d* in the inner part 54*c* of the first selector piece 54. Thus, the smoker can control the relative axial position of the first and second selector pieces 54, 55 by rotating one in relation to the other. The protrusion 55*d* and the recess 54*d* can include co-operating parts (not shown) for indexing the rotation and hence the axial displacement and/or for defining a stop position corresponding to a maximum axial separate of the first and second selector pieces 54, 55. Alternatively, such index and/or stop positions can be defined in other ways or not be defined.

A section at the near end of the outer part 55*a* of the second selector piece 55 has a reduced outer diameter. This section fits inside a section at the near end of the outer part 54*a* of the first selector piece 54. As shown in the figures, the part 54*a* can have on its inner wall an annular ridge 54*f* which engages with the outer wall of the part 55*a*, and the part 55*a* can have on its outer wall an annular ridge 55*j* which engages with the inner wall of the part 54*a*. The ridges 54*f*, 55*j* are for forming a relatively low-friction seal between the first and second selector pieces 54, 55. The seal is for preventing air being drawn into the first selector piece 54 (or for limiting the amount of such air). Alternatively, the ridges 54*f*, 55*j* can be omitted and such a seal formed directly between the inner and outer walls of the respective parts 54*a*, 55*a*.

The inner part 57 is longer than the outer filter part 58 and protrudes from the main filter part 52 at its near end. The intermediate layer 59 is coextensive with the inner filter part 57. The protruding part of the inner filter part 57 is received in the inner space 55*f* at the far end of the second selector piece 55. The inner space 55*f* has a tapered (conical) section at its far end. The taper is such that, at the far end of the taper, the inner space 55*f* is wider than the width (when un-deformed) of the inner filter part 52 and, at the near end of the taper, it is narrower. Thus, when assembled (as shown in the figures), the inner filter part 57 is deformed by and engages strongly with the intermediate part 55*b*. This arrangement is for holding the second selector piece 55 and the main filter part 52 together and forming a seal for preventing additive from passing between the inner and outer flow paths. Moreover, the arrangement makes it easier to assemble the filter 51 and reduces the risk of damage to the intermediate layer 59 during assembly.

Thus, the inner flow path defined by the inner filter part 57 is connected to the inner flow path defined by the inner space 55*f* in the second selector piece 55, while the outer flow path define by the outer filter part 58 is connected to the outer flow path defined by the outer space 55*g* in the second selector piece 55.

An elongated spike 55*e* is provided on the far end wall of the inner part 55*c* of the second selector piece 55. The longitudinal axis of the spike 55*e* coincides with the axis 56. The spike 55*e* extends in the axial direction towards (or beyond) the far end of second selector piece 55. The spike 55*e* is received by a hole in the inner filter part 57 and the friction therebetween holds the second selector piece 55 and the main filter part 52 together. The hole can be pre-formed or can be formed by the spike 55*e* during assembly. As shown in the figures, the spike 55*e* can have a cross-shaped cross section which decreases in size towards its far end. Alternatively, the spike (or spikes) may have different shapes.

The inner part 54*b* of the first selector piece 54 and the intermediate part 55*b* of the second selector piece are adapted so that they can co-operate with each other to open or close the inner flow path in the second selector piece 55 depending upon the relative axial position of the first and second selector pieces 54, 55. The inner space 55*f* in the second selector piece 55 has a tapered (conical) selection towards its near end, wherein the taper is such that the space 55*f* is wider at its near end. Also, the inner part 54*b* of the first selector piece 54 has a tapered (conical) section towards its far end, wherein the taper is such that the part 54*b* is narrower at its far end. The tapering of the part 55*b* is slightly shallower than the tapering of the space 55*f*.

In a closed position (as shown in the figures), an area of the inner part 54*b* of the first selector piece 54 is forced again an area of the inner wall of the intermediate part 55*b* of the second selector piece 55. Thus, a section of the space 55*f* is sealed and there can be no flow from the inner flow path in the second selector piece 55 into the flow path in the first selector piece 54. The smoking article would usually be supplied with the selector 51 in the closed position.

In open positions, in which the first and second selector pieces 54, 55 are further apart, there is a gap between the inner part 54*b* of the first selector piece 54 and the intermediate part 55*b* of the second selector piece 55. This gap allows flow from the inner flow path in the second selector piece 55 into the flow path in the first selector piece 54. The size of the gap increases as the axial separation of the first and second selector pieces 54, 55 increases. Thus, the resistance to flow through the gap decreases and hence the proportion of flow through the inner flow paths to flow through the outer flow paths increases (since the resistance of the outer flow paths is constant). If, for example, the inner filter part 57 contains flavourant (that may have been released from the additive release component as described above in relation to the first embodiment), then the proportion corresponds to a particular flavour strength. Thus, the flavour strength can be increased or decreased by increasing or decreasing the separation of the first and second selector pieces 54, 55.

As mentioned above, the relative movement of the first and second selector pieces 54, 55 can be indexed. The index positions can correspond to the closed position and to one or more different open positions, for example.

The filter 51 can be attached to the tobacco rod by a covering layer (not shown). The covering layer 60 can be made of a tipping paper or other suitable materials. In some embodiments, the covering layer can be secured around the first and second selector pieces 54, 55, the main filter part 52 and a section of the tobacco rod and can have a perforated or otherwise weakened line around where the first and second selector pieces 54, 55 meet. The perforated line is to be broken when the fist selector piece 54 is first rotated in relation to the second selector piece 55. Alternatively, the covering layer can be in two parts, the first of which is secured around the first selector piece 54 and the second of which is secured around the second selector piece 55, the main filter part 52 and a section of the tobacco rod. In such embodiments, the first part of the covering layer can overlap (without being secured to) the second part of the covering layer, thereby providing a larger area for the smoke to grip when rotating the first selector piece 54 in relation to the second selector piece 55. The covering layer may be provided with markings (not shown) for indicating various different positions or, for example, flavour strengths.

Third Embodiment

Figure 9A:
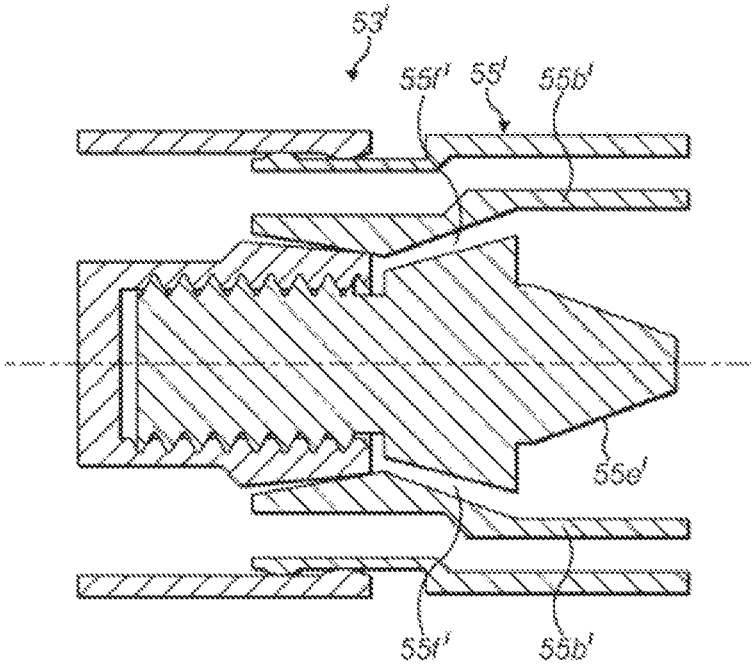
FIG. 9*a* is a cross-sectional view of a part of a filter according to a third embodiment of the invention.
Figure 9B:
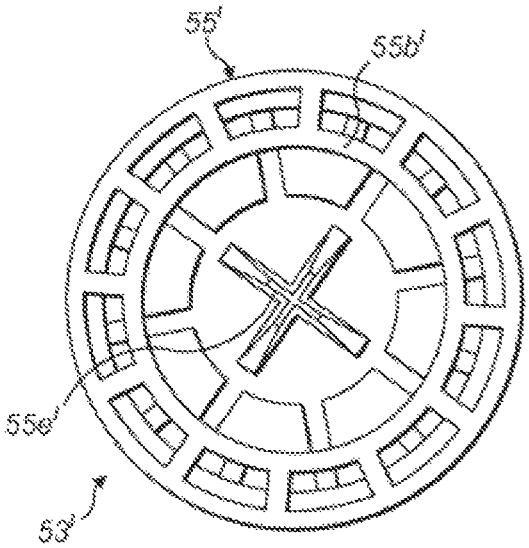
FIG. 9*b* is a second ("far") end view of the selector shown in FIG. 9*a;*

FIGS. 9*a* and 9*b* show different views of a selector 53' to be included in a filter according to a third embodiment of the invention. The selector 53' is the same as the selector 53 of the second embodiment expect that, firstly, the spike 53*e'* is wider and/or widens considerably more at its "near" end (the end away from the tobacco rod) than the spike 53*e* of the first embodiment. Secondly, the space 55*f'* for receiving the inner filter part (not shown) does not need to be tapered (conical) but can have a straight cylindrical shape. This is because, in this embodiment, the spike 53*e'* deforms the inner filter part so that its outer surface is forced radially outwards and engages strongly with the inner wall of the intermediate part 55*b*. As explained above, the engagement is for holding the second selector piece 55 and the main filter part 52 together and for forming a seal for preventing additive from passing between the inner and outer flow paths. Alternatively, provided that the spike 53*e'* is sufficiently wide, the space 55*f'* could be tapered such that it is wider towards its near end. Also, the spike 53*e'* does not need to have the form shown in the figure and can have any suitable form for deforming the inner filter part in the way described above.

Fourth Embodiment

Figure 10A:
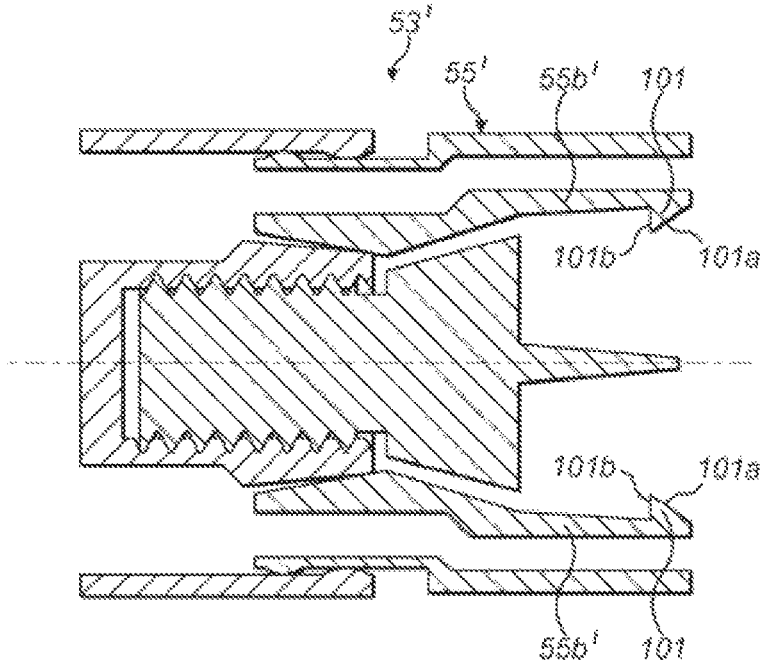
FIG. 10*a* is a cross-sectional view of a part of a filter according to a fourth embodiment of the invention.
Figure 10B:
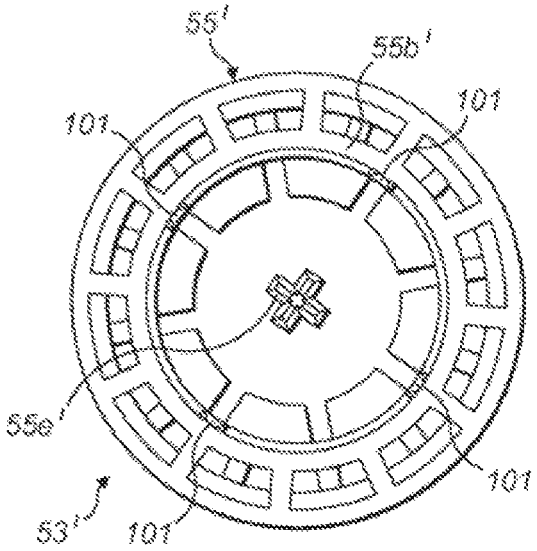
FIG. 10*b* is a second ("far") end view of the selector shown in FIG. 10*a;*

FIGS. 10*a* and 10*b* show different views of a selector 53" to be included in a filter according to a fourth embodiment of the invention. The selector 53" is the same as the selector 53 of the second embodiment expect for additional features which are provided to hold the second selector piece 55" and the main filter part (not shown) together more strongly. These additional features are a plurality of barb-like structures ("barbs") 101 which are provided on the inner wall of the intermediate part 55*b"* of the second selector piece 55". As shown in the figures, there can be four barbs 101 evenly distributed around the inner wall of the intermediate part 55*b"*. Alternatively, there can be different numbers of barbs 101. Also, the barbs can be positioned differently and, in some embodiments, can be positioned on the spike 55*e"*. As shown in the figures, each barb 101 can be generally wedge-shaped with a gently sloping slide 101*a* oriented towards the "far" end of the second selector piece 55" (i.e. the end towards the tobacco rod) and a steeply sloping side 101*b*. The gently sloping side 101*a* can also narrow towards the far end or the second selector piece 55". Alternatively, the barbs 101 can have different shapes. In any case, the barbs 101 are adapted so that the inner filter part (not shown) can be moved relatively easily into second selector piece 55" during assembly, but is then prevented from moving out of the second selector piece 55" by the barbs 101.

Fifth Embodiment

Figure 11A:
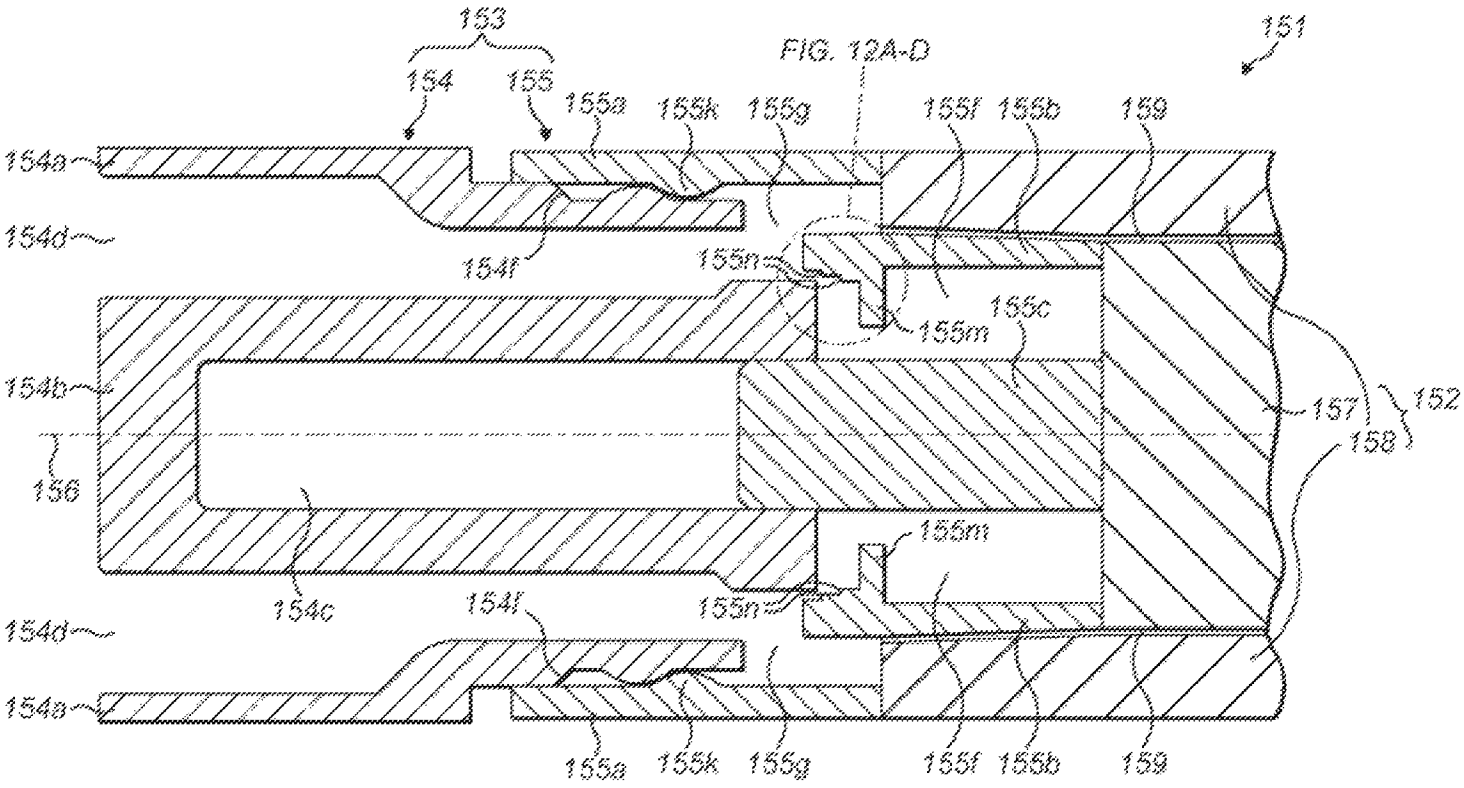
FIG. 11*a* is a cross-sectional view of a part of a filter according to a fifth embodiment of the invention.
Figure 11B:
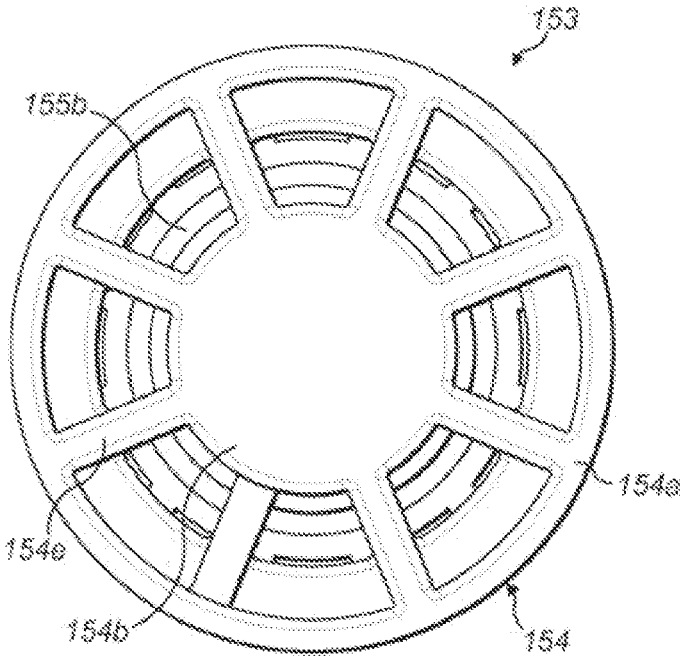
FIG. 11*b* is a first ("near") end view of the selector shown in FIG. 11*a;*
Figure 11C:
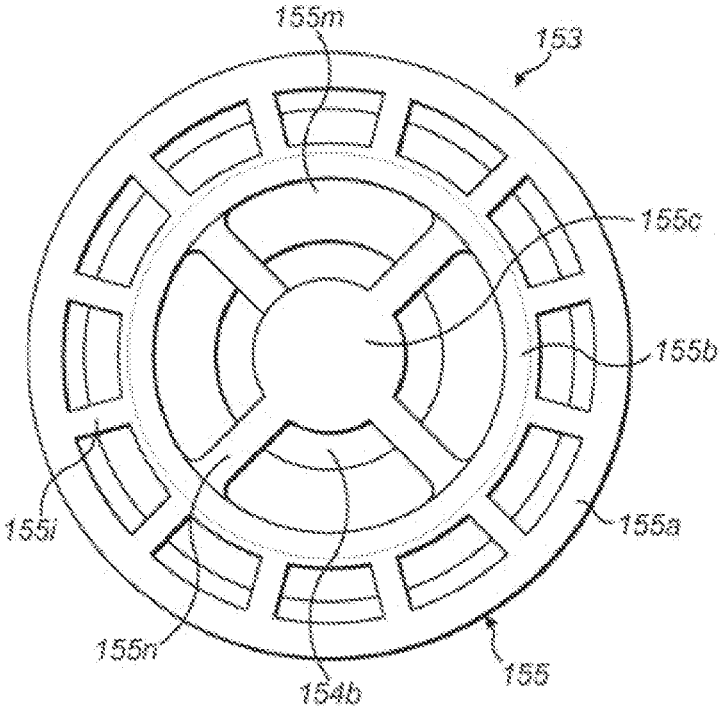
FIG. 11*c* is a second ("far") end view of the selector shown in FIG. 11*a;*

FIGS. 11*a*, 11*b* and 11*c* show different views of a part of a filter 151 according to a fifth embodiment of the invention. The filter 151 includes a main filter part 152, one end of which is to be attached to an end of a tobacco rod (not shown) similar to the tobacco rod 12 of the first embodiment, and another end of which is attached to a selector 153. The selector 153 includes first and second selector pieces 154, 155. As will be described in more detail below, the second selector piece 155 is attached to the main filter part 152, and the first selector piece 154 is moveably attached to the second selector piece 155. The tobacco rod, main filter part 152, and first and second selector pieces 154, 155 are generally-cylindrical, have a similar outer diameter, and are arranged co-axially, thereby defining an axis 156.

The words "near" and "far" are to be understood in the same way as in the second embodiment.

The main filter part 152 includes inner and outer filter parts 157, 158 which define respective inner and outer flow paths. The inner and outer flow parts 157, 158 are the same as the inner and outer filter part 13, 14 of the first embodiment, except that, as will be explained in more detail below, they have different lengths. As in the first embodiment, the inner filter part 157 includes an additive, such as flavourant, preferably included in an additive release component (not shown).

An intermediate layer 159 is arranged between the inner and outer filter parts 157, 158. The intermediate layer 159 is the same as the barrier layer 19 of the first embodiment.

The inner filter part 157 can have an additional plugwrap wrapping (not shown). The outer filter part 158 can also have a plugwrap wrapping (not shown).

The first and second selector pieces 154, 155 can be made of a plastics material or other suitable materials.

Similarly to the second embodiment, the first and second selector pieces 154, 155 are moveable in relation to each other in order to adjustably open and close the inner flow path in the second selector piece 155. However, in this embodiment, there are a number of discrete open states for the inner flow path.

The first selector piece 154 comprises an outer, generally-cylindrical tube part 154*a* and an inner, generally-cylindrical part 154*b*. The axes of the parts 154*a*, 514*b* are both coincident with the axis 156. The parts 154*a*, 514*b* are largely coextensive. The part 154*b* is solid except that it includes a recess 154*c*. An annular space 154*d* between the parts 154*a*, 154*b* defines a flow path through the first selector piece 154. The parts 154*a*, 154*b* are connected to each other by a plurality of spokes 154*e* similar to the spokes 54*e* of the second embodiment.

The second selector piece 155 includes an outer, generally-cylindrical tube part 155*a*, an intermediate, generally-cylindrical tube part 155*b* and an inner generally-cylindrical solid part 155*c*. The axes of the parts 155*a*, 155*b*, 155*c* are all coincident with the axis 156. The outer and intermediate parts 155*a*, 155*b* are axially offset from each other, with the outer part 155*a* positioned towards the nearer end and the intermediate part 155*b* positioned towards the far end of the second selector piece 155. The inner part 155*c* is largely coextensive with the intermediate part 155*b*. The intermediate part 155*b* divides the second selector piece 155 into inner and outer spaces 155*f*, 155*g* defining respective inner and outer flow paths. The intermediate and inner parts 155*b*, 155*c* are connected to each other by a plurality of inner spokes 155*h*. The outer an intermediate parts 155*a*, 155*b* are connected to each other by a plurality of outer spokes 155*i*. The spokes 155*h*, 155*i* are similar to the spokes 154*e* in the first selector piece 154.

The first and second selector pieces 154, 155 are attached to each other by way of a screw-threaded connection. A section at the far end of the first selector piece 154 has a reduced outer diameter and fits inside a section at the near end of the outer part 155*a* of the second selector piece 155. The outer wall of the first selector piece 154 and the inner wall of the outer part 155*a* of the second selector piece 155 include co-operating threaded sections 154*f*, 155*k*. Thus, the smoker can control the relative axial position of the first and second selector pieces 154, 155 by rotating one in relation to the other. The threaded sections 154*f*, 155*k* can include co-operating parts (not shown) for indexing the rotation and hence the axial displacement and/or for defining a stop position corresponding to a maximum axial separation of the first an second selector pieces 154, 155. Alternatively, such index and/or stop positions can be defined in other ways or not be defined. The threaded connection can form a seal for preventing air being drawn into the first selector piece 154 (or for limiting the amount of such air). As shown in the figure, there can also be an area of contact between unthreaded sections of the outer wall of the piece 154 and of the inner wall of the part 155*a*. This area of contact can also form the seal.

The near end of the inner part 155*c* of the second selector piece 155 is received by the recess 154*d* in the inner part 154*c* of the first selector piece 154. This arrangement helps maintain the co-axial alignment of the first and second selector pieces 154, 155.

The inner filter part 157 is shorter than the outer filter part 158, leaving a cylindrical recess in the main filter part 152 at its near end. The intermediate layer 159 is coextensive with the outer filter part 158. The intermediate and inner parts 155*b*, 155*c* of the second selector piece 155, which protrude from the second selector piece 155 are received in the recess in the main filter part 152. The intermediate part 155*b* of the second selector piece 155 has a tapered (conical) section at its far end. The taper is such that, at the far end of the taper, the part 155*b* is narrower than the width (when un-deformed) of the cylindrical recess in the main filter part 152 and, at the near end of the taper, it is wider. Thus, when assembled (as shown in the figures), the outer filter part 157 is deformed by and engages strongly with the intermediate part 155*b*. This arrangement is for holding the second selector piece 155 and the main filter part 152 together and forming a seal for preventing additive from passing between the inner and outer flow paths. Moreover, the arrangement makes it easier to assemble the filter 151 and reduces the risk of damage to the intermediate layer 159 during assembly.

Thus, the inner flow path defined by the inner filter part 157 is connected to the inner flow path defined by the inner space 155*f* in the second selector piece 155, while the outer flow path defined by the outer filter part 158 is connected to the outer flow path defined by the outer space 155*g* in the second selector piece 155.

The inner part 154*b* of the first selector piece 154 and the intermediate part 155*b* of the second selector piece are adapted so that they can co-operate with each other to open or close the inner flow path in the second selector piece 155 depending upon the relative axial position of the first and second selector pieces 154, 155. As mentioned above, in this embodiment, there are a number of discrete open states.

FIGS. 12*a*, 12*b*, 12*c* and 12*d* show the filter 151 in a closed position and in the three different open positions described below.

The intermediate part 155*b* of the second selector piece 155 has an annular ridge 155*m* on its inner wall.

Figure 12A:
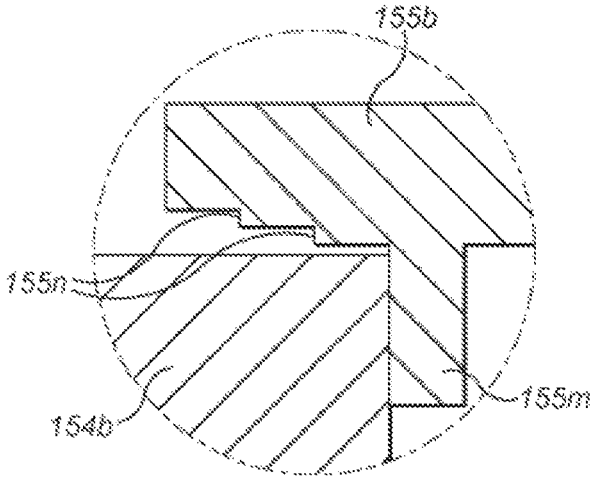
FIG. 12 is a close-up of the highlighted area of FIG. 11*a* for the selector in a closed position (a) and in first (b), second (c) and third (d) open positions.

In the closed position (as shown in FIGS. 11*a* and 12*a*), the far end wall of the inner part 154*b* of the first selector piece 154 is forced against the near side of the ridge 155*m*. Thus, a section of the space 155*f* in the second selector piece 155 is sealed and there can be no flow from the inner flow path in the second selector piece 155 into the flow path in the first selector piece 154. The smoking article is usually supplied with the selector 151 in the closed position.

Between the ridge 155*m* and the near end of the intermediate part 155*b*, there are a number of steps 155*n* where the inner diameter of the intermediate part 155*c* changes. At each step 155*n*, the inner diameter increases in the direction towards the near end of the second selector piece 155. As shown in the figure, there can be two such steps 155*n*. Alternatively, there can be a different number of steps or no steps. With two steps, there is a first section of the first part 155*b* with a first inner diameter, a second, nearer section with a second inner diameter larger than the first inner diameter and a third, even nearer section with a third inner diameter larger than the second inner diameter. The lengths of the sections between the steps 155*n* is larger than the heights of the steps 155*n*.

In open positions, in which the first and second selector pieces 154, 155 are further apart, there is a gap between the part 154*b* and the ridge 155*m*. This gap allows flow from the inner flow path in the second selector piece 155 into the flow path in the first selector piece 154.

Figure 12B:
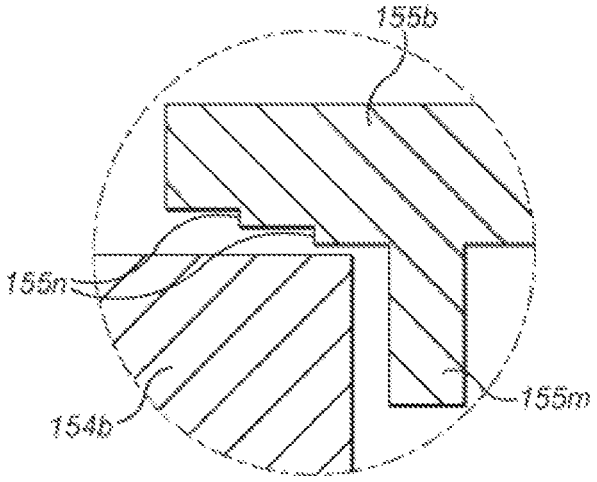

In the first open position (as shown in FIG. 12*b*), the part 154*b* is positioned so that it extends about halfway into the first section of the part 155*b* with the first inner diameter. The resistance to flow through the gap between the outer wall of the part 154*b* and the inner wall of the part 155*b* depends on the size of this gap.

Figure 12C:
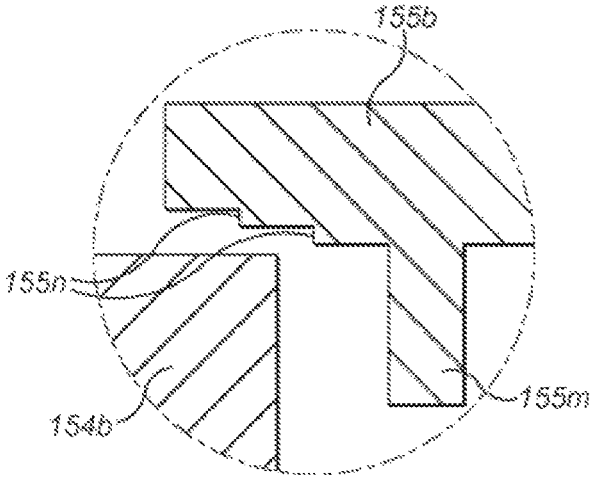

In the second open position (as shown in FIG. 12*c*), the part 154*b* is positioned so that it extends about halfway into the second section of the part 155*b*. Because the part 155*b* has a larger inner diameter in the second section than in the first section, the gap between the outer wall of the part 154*b* and the inner wall of the part 155*b* is larger in the second open position than it is in the first open position. Thus, the resistance to flow through the gap is lower.

Figure 12D:
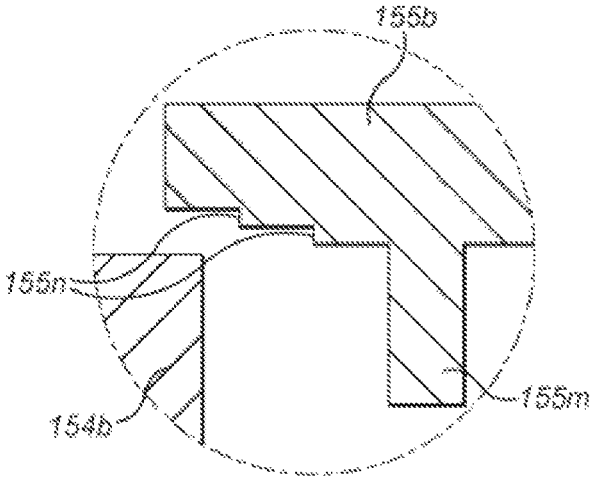

In the third open position (as shown in FIG. 12*d*), the part 154*b* is positioned so that it extends about halfway into the third section of the part 155*b*. Because the part 155*b* has a larger inner diameter in the third section than in the second section, the gap between the outer wall of the part 154*b* an the inner wall of the part 155*b* is larger in the third open position than it is in the second open position. Thus, the resistance to flow through the gap is lower.

In each case, a lower resistance to flow through the gap corresponds to a higher proportion of flow through the inner flow paths to flow through the outer flow paths increases (since the resistance of the outer flow paths is constant), and vice versa. If, for example, the inner filter part 157 contains flavourant (that may have been released from the additive release component as described above in relation to the first embodiment), then the proportion corresponds to a particular flavour strength. Thus, the flavour can be set to one of three different strengths by setting the selector 153 in one of the three different open positions.

A benefit of the stepped arrangement of this embodiment over the tapered arrangement of the second embodiment is that the preferred gap sizes can be defined during manufacture and selected by the user relatively easily, that is to say without requiring precise control of the relative axial position of the firs and second selector pieces 154, 155. The preferred gap sizes can include, for example, very small gaps which would otherwise be difficult for the user to select.

As mentioned above, the relative movement of the first an second selector pieces 154, 155 can be indexed and/or limited. The index and stop positions can correspond to the closed position and the three different open positions, for example.

The filter 150 can be attached to the tobacco rod by a covering layer (not shown) similar to that of the second embodiment.

Sixth Embodiment

Figure 13A:
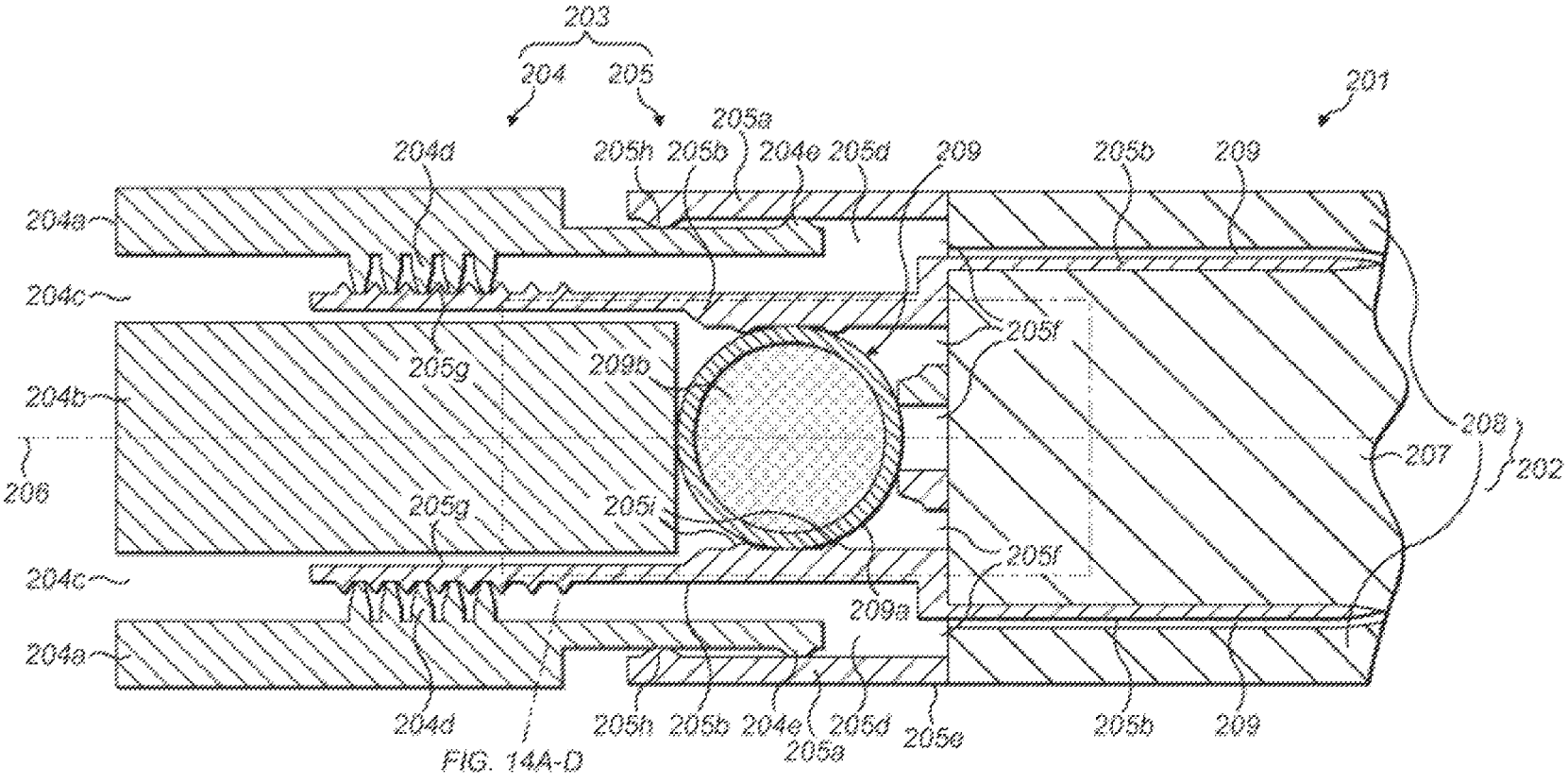
FIG. 13*a* is a cross-sectional view of a part of a filter according to a sixth embodiment of the invention.
Figure 13B:
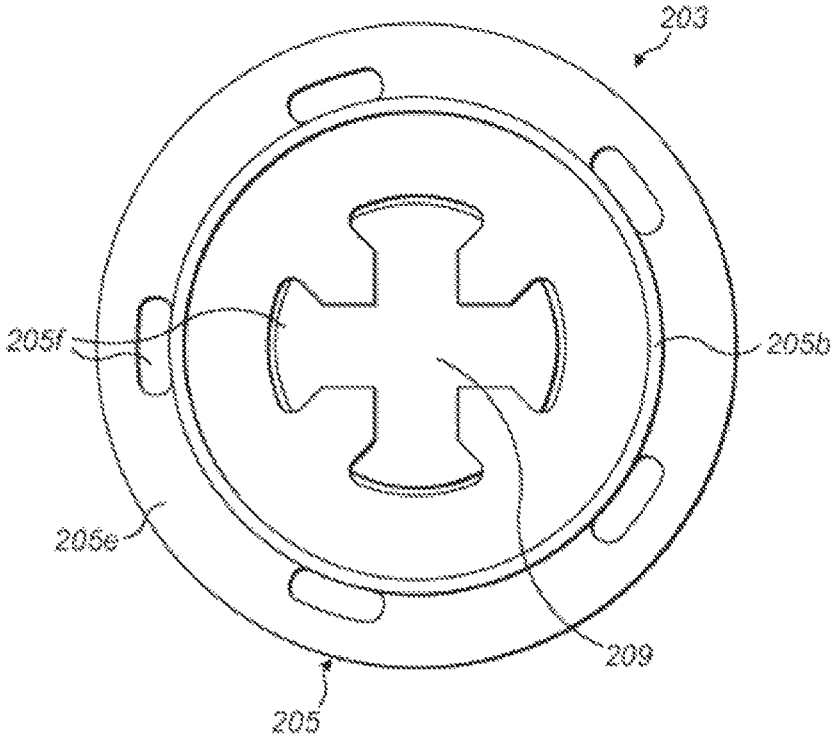
FIG. 13*b* is a second ("far") end view of the selector shown in FIG. 13*a;*

FIGS. 13*a* and 13*b* show a part of a filter 201 according to a sixth embodiment of the invention. The filter 201 includes a main filter part 202, one end of which is to be attached to an end of a tobacco rod (not shown) similar to the tobacco rod 12 of the first embodiment, an another end of which is attached to a selector 203. The selector 203 includes first and second selector pieces 204, 205. As will be described in more detail below, the second selector piece 205 is attached to the main filter part 202, and the first selector piece 204 is moveably attached to the second selector piece 205. The tobacco rod, main filter part 202, and first and second selector pieces 204, 205 are generally-cylindrical, have a similar outer diameter, and are arranged co-axially, thereby defining an axis 206.

The words "near" and "far" are to be understood in the same way as in the second embodiment.

The main filter part 202 includes inner and outer filter parts 207, 208 which define respective inner and outer flow paths. The inner and outer filter parts 207, 208 are the same as the inner and outer filter part 13, 14 of the first embodiment, except that they need not include any additive. Rather, an additive release component 209 is provided within the second selector piece 204, as will be explained in more detail below.

An intermediate layer 210 is arranged between the inner and outer filter parts 207, 208. The intermediate layer 210 is the same as the barrier layer 19 of the first embodiment.

The inner filter part 57 can have an additional plugwrap wrapping (not shown). The outer filter part 58 can also have a plugwrap wrapping (not shown).

The first and second selector pieces 204, 205 can be made of a plastics material or other suitable materials.

As will become apparent, the first and second selector pieces 204, 205 are moveable in relation to each other in order to, firstly, release the additive from the additive release component 209 and, secondly, adjustably open and close the inner flow path.

The first selector piece 204 comprises an outer, generally-cylindrical tube part 204*a* and an inner, generally-cylindrical solid part 204*b*. The axes of the parts 204*a*, 204*b* are both coincident with the axis 206. The parts 204*a*, 204*b* are largely coextensive. An annular space 204*c* between the parts 204*a*, 204*b* defines a flow path through the first selector piece 204. The parts 204*a*, 204*b* are connected to each other towards their near ends by spokes (not shown) similar to the spokes 54*e* of the second embodiment.

The second selector piece 205 includes an outer, generally-cylindrical tube part 205*a*, and an inner generally-cylindrical tube part 205*b*. The axes of the parts 205*a*, 205*b* are both coincident with the axis 206. The outer part 205*a* is shorter than the inner part 205*b* and is arranged centrally in relation to the inner part 205*b*. The inner part 205*b* divides the second selector piece 205 into inner and outer spaces 205*c*, 205*d* defining respective inner and outer flow paths. The parts 205*a*, 205*b* are connected to each other by a disc-shaped structure 205*e* at the far end of the outer part 205*a*. The disc 205*e* is orientated perpendicularly to the axis 206. As will be explained in more detail below, the disc 205*e* is punctured in the axial direction by a plurality of holes 205*f*.

The first and second selector pieces 204, 205 are attached to each other by way of a screw-threaded connection. The inner wall of the outer part 204*a* of the first selector piece 204 and the outer wall of the inner part 205*b* of the second selector piece 205 include co-operating threaded sections 204*d*, 205*g*. The section 204*d* is towards the middle of the part 204*a*, while the section 205*g* is towards the near end of the part 205*b*. Thus, the smoker can control the relative axial position of the first and second selector pieces 204, 205 by rotating one in relation to the other. The threaded connection is adapted to allow flow through it. This can involve one or both of the sections 204*d*, 205*g* having axially-extending gaps (not shown) therein. The sections 204*d*, 205*g* can include co-operating parts (not shown) for indexing the rotation and hence the axial displacement and/or for defining a stop position corresponding to a maximum axial separation of the first and second selector pieces 204, 205. Alternatively, such index and/or stop positions can be defined in other ways or not be defined.

A section at the far end of the outer part 204*a* of the first selector piece 204 has a reduced outer diameter. This section fits inside a section at the near end of the outer part 205*a* of the second selector piece 205. As shown in the figures, the part 205*a* can have on its inner wall an annular ridge 205*h* which engages with the outer wall of the part 204*a*, and the part 204*a* can have on its outer wall an annular ridge 204*e* which engages with the inner wall of the part 205*a*. The ridges 204*e*, 205*h* are for forming a relatively low-friction seal between the first and second selector prices 204, 205. The seal is for preventing air being drawn into the first selector piece 204 (or for limiting the amount of such air). Alternatively, the ridges 204*e*, 205*h* can be omitted and such a seal formed directly between the inner and outer walls of the respective parts 204*a*, 205*a*.

The inner part 205*b* of the second selector piece 205 extends axially from the far side of the disc 205*e* in the form of a thin cylindrical tubular section. As shown in the figure, in this section, the inner diameter of the part 205*b* can be constant, while the outer diameter and hence the wall thickness of the part 205*b* decreases towards the far end thereof. The part 205*b* is positioned between the inner and outer filter parts 207, 208, with the intermediate layer 209 positioned outside the part 205*b*. Alternatively, the outer diameter of the part 205*b* can be constant, while the inner diameter decreases toward the far end thereof, and the intermediate layer 209 may be positioned inside the part 205*b*. In either case, the arrangement is for holding the second selector piece 155 and the main filter part 152 together for forming a seal for preventing additive from passing between the inner and outer flow paths.

Some of the holes 205*f* in the disc 205*e* connect the outer flow path defined by the outer filter part 208 to the outer flow path defined by the outer space 205*d* in the second selector piece 205, and other holes 205*f* connect the inner flow path defined by the inner filter part 207 to the inner flow path defined by the inner space 205*e* in the second selector piece 205.

The first and second selector pieces 204, 205 are adapted so that they can co-operate with each other to, firstly, release the additive from the additive release component 209 and, secondly, adjustably open and close the inner flow path.

The inner part 205*b* and the disc 205*e* of the second selector piece 205 form a holder for the additive release component 209. As shown in the figure, the component 209 can be in the form of a frangible capsule 209*a* containing a liquid flavourant 209*b*. Alternatively, other types of additive release component can be provided, such as those described elsewhere. As shown in the figure, a pair of annular ridges 205*i* can be provided on the inner wall of the part 205*b* for holding the component 209 in place. A plurality of spike-like structure 205*j* extend axially from the near side of the disc 205*e* and are in contact with the component 209.

FIGS. 14*a*, 14*b*, 14*c* and 14*d* respectively show the filter 201 in an initial position, a so-called release position, a closed position and an open position.

Figure 14A:
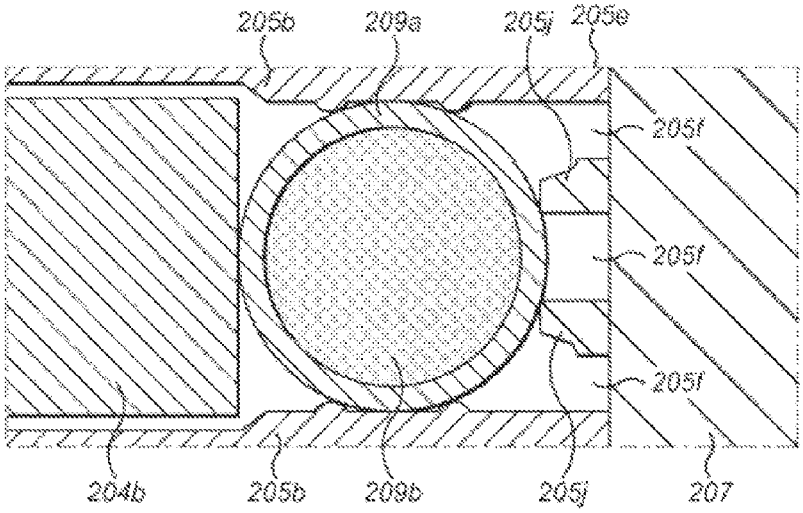
FIG. 14 is a close-up of the highlighted area of FIG. 13*a* for the selector in an initial position (a), in a release position (b), in a closed position (c) and in an open position (d).

In the initial position (as shown in FIGS. 13*a* and 14*a*), the far end wall of the inner part 204*b* of the first selector piece 204 is not in contact or is in sufficiently light contact with the component 209 so as not to cause it to break.

Figure 14B:
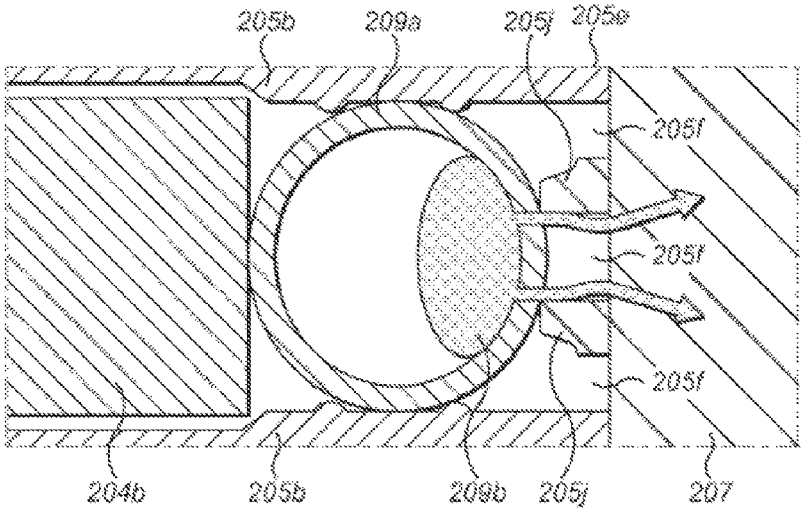

The first and second selector pieces 154, 155 can be moved closer together and the far end wall of the part 204*b* can urge the components 209 against the spikes 205*j*. In the release position (as shown in FIG. 14*b*), the unbroken capsule 209*a* is broken by the spikes 205*j* and releases the flavourant 209*b*. At least one of the holes 205*f* in the disc 205*j* is aligned with the component 209 for allowing the released flavourant 209*b* to flow into the inner part 207.

The inner space 205*e* in the second selector piece 205 has a tapered (conical) section towards its centre, wherein the taper is such that the space 205*e* is wider at its near end. The inner part 204*b* of the first selector piece 204 is cylindrical.

Figure 14C:
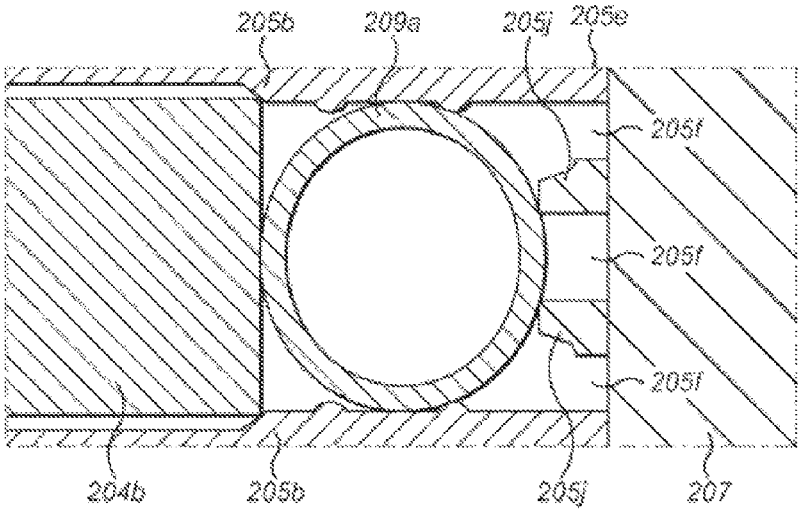
Figure 14D:
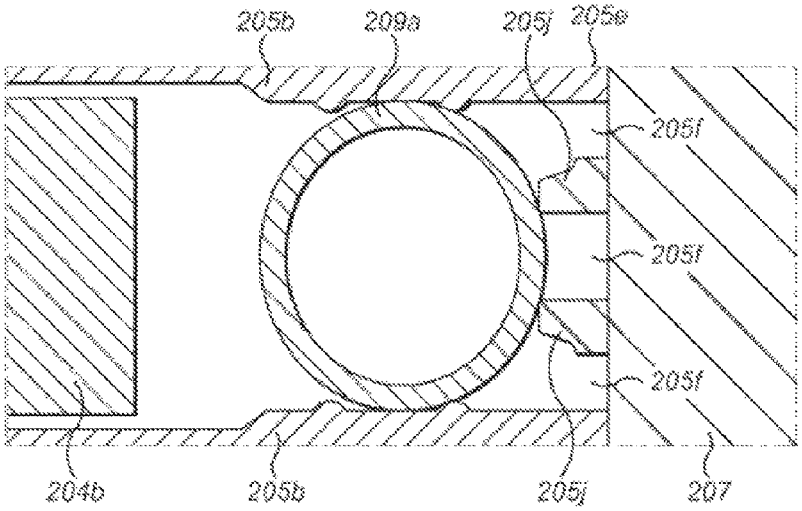

In the closed position (as shown in FIG. 14*c*), an area of the inner part 204*b* of the first selector piece 204 is forced against an area of the inner wall of the intermediate part 205*b* of the second selector piece 205. Thus, a section of the space 205*e* is sealed and there can be no flow from the inner flow path in the second selector piece 205 into the flow path in the first selector piece 204. The closed position can be the same as the release position, or the first and second selector pieces 204, 205 can be closer together in the closed position than in the release position.

In open position, in which the first and second selector pieces 204, 205 are further apart, there is a gap between the inner part 204*b* of the first selector piece 204 and the intermediate part 205*b* of the second selector piece 205. This gap allows flow from the inner flow path in the second selector piece 205 into the flow path in the first selector piece 204. The size of the gap increases as the axial separation of the first and second selector pieces 204, 205 increases. Thus, the resistance to flow through the gap decreases and hence the proportion of flow through the inner flow paths to the flow through the outer flow paths increases (since the resistance of the outer flow paths is constant). After the flavourant 209*b* has been released, the proportion corresponds to a particular flavour strength.

Thus, the smoker can control the release of the flavourant and then control the flavour strength using the same action, namely by rotating the first and second selector pieces 204, 205 in relation to each other.

As mentioned above, the relative movement of the first and second selector pieces 204, 205 can be indexed. The index positions can correspond to the initial position, the release position, the closed position and one or more different open positions.

The filter 200 can be attached to the tobacco rod by a covering layer (not shown) similar to that of the second embodiment.

Variations of the Second, Third, Fourth, Fifth and Sixth Embodiments

Some variations of the filters according to the second, third, fourth, fifth and sixth embodiments will now be described.

The embodiments may include features of any of the other of the embodiments. For instance, any of the embodiments may use any of the described arrangements for holding the second selector piece and the main filter part together. Also, any of the second, third, fourth and sixth embodiments may use the stepped arrangement of the fifth embodiment rather than the tapered arrangement for opening or closing the inner smoke paths, and vice versa.

Instead of spokes (e.g. the spokes 54*e* of the second embodiment), the various parts of the first and second selector pieces can be connected to each other by other structures which allow flow through them. An example of such a structure is the punctured disc 205*e* of the sixth embodiment.

Instead of the screw-threaded connection (e.g. the threaded sections 154*f*, 155*k* of the fifth embodiment), the first and second selector pieces can be moveably connected to each other in other suitable ways. Moreover, the first selector piece need not need to be rotated in relation to the second selector piece. Instead, for example, the first selector pieces can simply be slid towards or away from the second selector piece. In this case, the first and second selector pieces can be connected to each other by a suitable sliding connection. Furthermore, in this case, some or all of the cylindrical parts of the first and second selector pieces can have differently shaped cross sections, such as a square.

Instead of the described co-operating parts (for example, the tapered (conical) sections of the second embodiment), other suitable parts for opening or closing the inner flow path in the second selector piece can be used. Such parts could include different combination of tapers sections, cylindrical sections, annular ridges, etc.

Instead of the overlapping region between the first and second selector pieces (for example, the sections with the ridges 204*e*, 205*h* in the sixth embodiment), other suitable ways of forming a seal for preventing air being drawn into the first selector piece can be used.

Instead of the described arrangements, other suitable ways of holding the second selector piece and the main filter part together an also for forming a seal for preventing additive from passing between the inner and outer flow paths can be used.

The embodiments include particular co-operating features on the first and second selector pieces, and/or features which have a particular orientation. However, where suitable, the co-operating features can be provided on the different ones of the first and second selector pieces, and/or can have a different orientation.

Further Variations

It should be realised that the foregoing example embodiments should not be construed as limiting. Other variations and modifications will be apparent to persons skilled in the art upon reading the application.

For example, in the embodiments other than the sixth embodiment, the additive is included in the inner flow path in the main filter part. Alternatively or additionally, additive can be included in the outer flow path. In the fifth embodiment, additional additive can be included in the main filter part 202. There may be one flow path containing one additive and one flow path containing another, different additive. One flow path may include more than one different additive, preferably in more than one additive release components. These additives may have complementary effects or flavours. Alternatively, neither of the flow paths may include additive and instead the flow paths may have different characteristics relating to, e.g., the type of filtration of the smoke or the amount of ventilating air which is introduced.

Where the additive or one of the additives includes charcoal, this can be included in the outer filter part in the form of a charcoal patch on the inside of the outer plugwrap.

Instead of being for the flow of smoke, one or both of the flow paths may be flow paths for the flow of flavourant only, ventilating air only, or flavourant and ventilating air only. These flow paths need not pass through a filter part that includes filtration material.

There may be three or more flow paths. For example, there may be a plurality of grooves channels around the outer circumference of an unflavoured part. The channels may be separated from the unflavoured filter part by a corrugated barrier layer. The channels may contain additive, e.g., menthol flavourant. A rotating part of the end of the filter further from the tobacco rod may be provided to open to close the channels and hence open or close a flow path, e.g., for smoke, through the menthol environment.

The three or more flow paths may contain different additives or have different characteristics and may be individually selectable.

The additive need not be included in an additive release component. In this case, the smoker does not need to first release the additive and can simply use the selector to change the proportion of modified smoke.

The selector may be any selecting means for allowing flow selectively through the first and second flow paths.

As used herein, the terms "flavour" and "flavourant" refer to materials which, where local regulations permit, may be used to create a desired taste or aroma in a product for adult consumers. They may include extracts (e.g., licorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamon, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other additives such as charcoal, chlorophyll, minerals, botanicals, or breath freshening agents. They may be imitation, synthetic or natural ingredients or blends thereof. They may be in any suitable form, for example, oil, liquid, or powder.

The additive release components may be capsules having an outer shell, containing additive fluid (liquid or powder) in an interior cavity. The outer shell of each additive release component is frangible to release all of the additive on application of pressure.

The filter may comprise a reaction surface against which the additive release component can be urged, in order to facilitate release of additive. In particular, the additive release components may be located on a periphery of the filter. The radially adjacent filtration material may provide a reaction surface against which the additive release component can be urged. Preferably, the filtration material may be relatively hard (e.g. by containing an increased amount of plasticiser) to form the reaction surface, and may have a hardness on the Filtrona scale of more than 90%. The additive release components may be located within the filtration material, or may be located in a cavity adjacent to the filtration material. The cavity may be formed by an elongate inner rod of filtration material, which one or two annular outer sections of filtration material surround. A covering layer forming an exterior of the filter is attached to one or both of the outer section of filtration material, and spaced from the inner rod to define a cavity. Preferably, the inner rod is harder than the annular outer sections, optionally by containing more plasticiser.

Alternatively, each additive release component may release its additive contents in a plurality of discrete doses, preferably actuated by a plurality of separate applications of pressure. This type of additive release component may comprise a resiliently or plastically deformable outer shell, preferably configured to release additive through a slit formed in a pre-determined area. Alternatively, this type of additive release components may comprise a porous absorbent substrate having an open cell structure (e.g. open cell foam), in which the additive is contained. The substrate may be at least partially resiliently deformable. The substrate is surrounded by an outer shell to retain the additive, which may be frangible, resiliently deformable, plastically deformable, or a thin coating. The substrate may form discrete additive release components, or may be in the form of an annulus in the first filter section. Alternatively, this type of additive release component may comprise a porous matrix containing the additive in discrete cavities and having a closed cell structure (e.g. closed cell foam), which is plastically deformable to release the additive.

The additive release components may be individually attached to the filter or substrate. Alternatively, the additive release components may be connected by a web, and may be connected by laminated strips of sheet material. Alternatively, the strips of sheet material may form the additive release components, such that the additive release components do not have a separate outer shell, and the strips of sheet material contain the additive.

The additive release components may be manually manipulated to release the additive or a movable part may be configured such that the movement of the movable part around an exterior of the smoking article releases additive from at least one of the additive release components. The movement is preferably sliding or rotation, by a ring or C-shaped clip, over an external surface of the filter. The filter may provide a reaction surface, against which the additive release components are urged by the movable part. The additive release components may be located in one or more grooves, extending circumferentially, longitudinally or helically. Alternatively, the movable part comprises a covering layer defining two adjacent surfaces, wherein the additive release components are located between the adjacent surfaces such that relative movement of the adjacent surfaces of the covering layer releases additive from at least one of the additive release components.

The additive release components are preferably spherical. Alternatively, the additive release components may be elongate, with a longitudinal axis extending parallel to a longitudinal axis of the filter. The elongate additive release components preferably has a circular or elliptical cross-section, and contain more additive than an additive release component of the same diameter. The elongate additive release component preferably has a maximum lateral extend of less than 3.5 mm, or less than 3 mm, or from 2 mm to 3 mm. Alternatively, or in addition, the elongate additive release components may be a radial cross-sectional areas which is less than 50% of the radial cross-sectional area of the smoking article, and optionally, less than 40% or less than 30%.

The additive release components are preferably individually located in the smoking article. Alternatively, a plurality of the additive release components may be surrounded by an outer wall or outer encapsulation. The outer encapsulation may be porous or configured to rupture or deform to allow release of additive on compression. The outer encapsulation may itself be contained within a further encapsulation. The additive may be contained within a plurality of discrete cavities within an open cell substrate, or a closed cell substrate. The open cell substrate, and optionally the closed cell substrate, have an outer encapsulation. One or more additive release components may be affixed to an exterior of a substantially larger additive release component. Alternatively, a plurality of additive release components, of the same or different sizes, may be affixed together. Any of these embodiments may be considered as a plurality of components connected in a unitary structure.

Embodiments of the invention are configured to comply with applicable laws and/or regulations, such as, by way of non-limiting example, regulations relating to flavours, additives, emissions, constituents, and/or the like. For example, the invention may be configured such that a smoking article implementing the invention is compliant with applicable regulations before an after adjustment by a smoker. Such implementations may be configured to be compliant with applicable regulations in all smoker-selectable positions. In some embodiments, the configuration is such that a smoking article implementing the invention meets or exceeds required regulatory test(s) in all smoker-selectable positions, such as, by way of non-limiting example, the testing threshold(s)/ceiling(s) for cigarette emissions an/or smoke constituents.

In order to address various issues and advance the art, the entirety of this disclosure shows by way of illustration various embodiments in which the claimed invention(s) may be practice and provide for superior filters for smoking articles. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, an that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A filter for a smoking article, the filter comprising a first flow path through the filter, a second flow path through the filter, the second flow path being disposed around the first flow path, and a selector having an inner space connected to the first flow path and an outer space connected to the second flow path configured to selectively allow flow through the first and second flow paths and for selectively closing the inner space such that there can be no flow through the first flow path in response to user manipulation of the filter.

2. The filter according to claim 1, wherein the selector includes a part that is movable in relation to the first and second flow paths to permit the selection.

3. The filter according to claim 1, wherein the first and second flow paths extend coaxially along the filter and the first flow path is disposed within the second flow path.

4. The filter according to claim 3, wherein a cylindrical first filter part and a hollow cylindrical second filter part around the first filter part respectively define the first and second flow paths.

5. The filter according to claim 4, wherein an extended part of the first filter part is received in a recess in the selector.

6. The filter according to claim 5, wherein the selector includes a protrusion on the end wall of the recess that extends into and engages with at least one of the first filter part and at least one further protrusions on a side wall of the recess, wherein the further protrusion is adapted to allow movement of the first filter part towards the end wall of the recess during assembly and thereafter prevent movement in the opposite direction.

7. The filter according to claim 6, wherein the protrusion is adapted to distort the first filter part so that it engages with the side wall of the recess.

8. The filter according to claim 5, wherein a layer is arranged between the first and second filter parts and extends with the first filter part into the recess.

9. The filter according to claim 4, wherein an extended part of the second filter part forms a recess that receives a tubular part of the selector.

10. The filter according to claim 4, wherein the selector comprises:

a first selector part, substantially fixed in relation to the first and second filter parts; and a second selector part which is at least one of rotatable and axially displaceable in relation to the first selector part.

11. The filter according to claim 10, wherein:

the first selector part has a first set of one or more windows aligned with the first filter part and a second set of one or more windows aligned with the second filter part; and the second selector part is rotatable in relation to the first selector part and has a third set of one or more windows alignable with the first set of windows configured to select the first flow path, or with the second set of windows configured to select the second flow path, or with a proportion of the first and second sets of windows configured to select the proportion of the first and second flow paths.

12. The filter according to claim 10, wherein:

the first selector part has a first flow path in communication with the first flow path defined by the first filter part and a second flow path in communication with the second flow path defined by the second filter part; and the second selector part is axially displaceable in relation to the first selector part and has a part adapted to open or close a section of the first flow path in the first selector part in dependence upon the axial displacement.

13. The filter according to claim 12, wherein one of the part and the section has a conical shape.

14. The filter according to claim 12, wherein:

the part has a constant outer diameter;

the section comprises two or more constant-diameter sections separated by one or more steps; and the part is moveable into a selected one of the constant-diameter sections thereby permitting the selection of one of two or more discrete levels of flow through the first flow path.

15. The filter according to claim 12, further comprising a threaded connection between the first and second selector parts for allowing the axial displacement to be changed based on a rotating force.

16. The filter according to claim 4, further comprising: an additive release component in the selector, the additive release component configured to release an additive in response to being at least one of deformed and broken, wherein the selector comprises:

a first selector part, substantially fixed in relation to the first and second filter parts; and a second selector part which is at least one of rotatable and axially displaceable in relation to the first selector part; and wherein the part of the second selector part is further adapted to urge the additive release component against a part of the first selector part so as to release the additive.

17. The filter according to claim 16, wherein the part of the first selector part includes one or more protrusions adapted to cause the additive to be released preferentially into the first filter part.

18. The filter according to claim 1, wherein at least one of the flow paths includes an additive.

19. The filter according to claim 1, further comprising an additive release component adapted to release an additive in response to being at least one of deformed and broken.

20. The filter according to claim 19, wherein the additive release component is included in the selector.

21. The filter according to claim 1, further comprising an additive release component included in the first flow path.

22. A filter for a smoking article, the filter comprising a first flow path through the filter, a second flow path through the filter, the second flow path being disposed around the first flow path, and a part that is configured to be movable in relation to the first and second flow paths by user manipulation of the filter to selectively allow flow through the first and second flow paths and to selectively close the first flow path such that there is no flow therethrough, wherein the part forms an inner space connected to the first flow path and an outer space connected to the second flow path and wherein the part is moveable to close the inner space and thereby close the first flow path.

* * * * *

UNITED STATES PATENT AND TRADEMARK OFFICE

CERTIFICATE OF CORRECTION

PATENT NO. : 8,960,198 B2
APPLICATION NO. : 14/080487
DATED : February 24, 2015
INVENTOR(S) : Mark Bailey et al.

It is certified that error appears in the above-identified patent and that said Letters Patent is hereby corrected as shown below:

On the title page (1):

Item (73) Assignee:

"British American Tobacoo (Investments) Limited" should be changed to
-- British American Tobacco (Investments) Limited --

Signed and Sealed this
Fourth Day of August, 2015

Michelle K. Lee

Michelle K. Lee
*Director of the United States Patent and Trademark Office*